US006132536A

United States Patent [19]

Hohmann et al.

[11] Patent Number: 6,132,536

[45] Date of Patent: Oct. 17, 2000

[54] AUTOMATED PROPELLANT BLENDING

[75] Inventors: Carl W. Hohmann; Douglas W. Harrington, both of Houston; Maureen L. Dutton, Friendswood; Billy Charles Tipton, Jr.; James W. Bacak, both of Houston; Frank Salazar, Texas City, all of Tex.

[73] Assignee: The United States of America as represented by the Administrator of the National Aeronautics and Space Administration, Washington, D.C.

[21] Appl. No.: 09/173,609

[22] Filed: Oct. 7, 1998

Related U.S. Application Data

[62] Division of application No. 08/917,581, Aug. 20, 1997, Pat. No. 5,879,079.

[51] Int. Cl.[7] ..... C06B 21/00

[52] U.S. Cl. ..... 149/19.92; 149/19.3

[58] Field of Search ..... 149/19.3, 19.92

[56] References Cited

U.S. PATENT DOCUMENTS

| | | | |
|---|---|---|---|
| H761 | 4/1990 | Quinlan | 149/19.92 |
| 3,155,749 | 11/1964 | Rossen et al. | 149/19.92 |
| 3,638,573 | 2/1972 | Campbell | 149/14 |
| 3,640,070 | 2/1972 | Kaufman et al. | 149/19.3 |
| 3,685,163 | 8/1972 | Olt | 149/76 |
| 3,697,668 | 10/1972 | Campbell | 149/2 |
| 3,706,608 | 12/1972 | Geisler | 149/6 |
| 3,853,645 | 12/1974 | Kaufman et al. | 149/19.3 |
| 3,876,477 | 4/1975 | Eldridge et al. | 149/19.3 |
| 3,878,121 | 4/1975 | Roche et al. | 149/8 |
| 3,891,482 | 6/1975 | Brown et al. | 149/19.3 |
| 3,892,610 | 7/1975 | Huzinec | 149/7 |
| 3,954,526 | 5/1976 | Mangum et al. | 149/7 |
| 3,981,756 | 9/1976 | Gotzmer | 149/19.3 |
| 4,012,244 | 3/1977 | Kaufman et al. | 149/19.3 |
| 4,315,785 | 2/1982 | Brodman et al. | 149/19.8 |
| 5,059,261 | 10/1991 | Condo et al. | 149/19.92 |
| 5,156,779 | 10/1992 | McGowan | 264/3.3 |
| 5,281,286 | 1/1994 | Sayles | 149/19.92 |
| 5,565,651 | 10/1996 | Kim et al. | 149/19.92 |
| 5,587,553 | 12/1996 | Braithwaite et al. | 149/19.6 |
| 5,728,964 | 3/1998 | Avory et al. | 149/19.3 |

*Primary Examiner*—Edward A. Miller
*Attorney, Agent, or Firm*—Hardie R. Barr

[57] ABSTRACT

An automated propellant blending apparatus and method uses closely metered addition of countersolvent to a binder solution with propellant particles dispersed therein to precisely control binder precipitation and particle aggregation. A profile of binder precipitation versus countersolvent-solvent ratio is established empirically and used in a computer algorithm to establish countersolvent addition parameters near the cloud point for controlling the transition of properties of the binder during agglomeration and finishing of the propellant composition particles. The system is remotely operated by computer for safety, reliability and improved product properties, and also increases product output.

20 Claims, 19 Drawing Sheets

AUTOMATED PROPELLANT BLENDING

This application is a division of application Ser. No. 08/917,581, filed Aug. 20, 1997, now U.S. Pat. No. 5,879,079.

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

FIELD OF THE INVENTION

The present invention relates to apparatus and methodology for blending propellant or explosive mixtures of a fuel and an oxidant with a binder.

BACKGROUND OF THE INVENTION

Pyrotechnic compositions are used for may useful purposes. Such compositions are used in the aerospace industry to provide ignition, propulsion, vehicle separation, and emergency egress. The automotive industry also uses ignition and gas production compositions for occupant restraint systems, i.e. airbags. The demand for these pyrotechnic mixtures continues to grow.

A typical pyrotechnic device is the NASA standard initiator (NSI). The NSI is a two-pin electrically activated, electro-explosive device containing zirconium potassium perchlorate (ZPP) propellant. Initially designed and used in 1966 for the Apollo lunar mission, the standard NSI is still used today in the NASA space shuttle system.

The propellant used in the NSI is a composition of finely divided zirconium, potassium perchlorate and graphite held together with a fluoroelastomer polymer as a binder. The mixture, besides being highly reliable, is very sensitive to ignition stimulus, particularly static discharge. The propellant is an extremely fast brisant explosive. These properties make the manufacture and handling of bulk quantities of ZPP very hazardous.

In the automotive industry, inflatable vehicle occupant restraint systems are standard equipment included in millions of new vehicles every year. Although different propellants are sometimes used in automotive applications, the initiators are very similar to the NSI's in that they usually use a ZPP propellant and are generally activated by electrical stimulation. The manufacture of propellants has been an inherently dangerous task owing to the risk of fire or explosion. The pyrotechnics industry has experienced accidents in the manufacture of energetic compositions, particularly with hand blending techniques. Flare and illumination compositions based on metal fuels such as, for example titanium, aluminum, magnesium and the like, exhibit characteristics similar to ZPP.

The performance of an energetic material such as ZPP is dependent on many factors such as purity, particle size distribution, particle shape, surface area, and the like. One of the factors affecting the reproducibility of the performance of a propellant is the degree of mixing, or homogeneity of the blend. A pyrotechnic composition that has been poorly mixed often exhibits slower burn rates and is less dependable than a well-mixed one. Some pyrotechnic compositions make use of a binder system that serves as an adhesive, holding the fuel and oxidant in a well-mixed condition. Without a binder many compositions separate under the influence of gravity or vibration, resulting in performance degradation. Therefore, proper mixing and incorporation of the binder during manufacture are key process parameters.

Heretofore, the blending of the NSI propellant ingredients has been done by hand, typically using a solvent evaporation procedure. The propellant components were generally poured in the form of dry powders into a 45 degree inclined bowl rotating with a solution of the binder (fluoropolymer in acetone or n-butyl acetate, for example). Manipulating the blend for homogeneity, the solvent was evaporated to leave the binder and obtain a moist solid. The moist solid was then sieved in air through a screen, often by hand. The screened propellant composition was then dried to remove the residual solvent. This process has produced good propellant, but has a number of disadvantages. The solvent evaporation technique relies on manual and frequent movement of the mix during processing to achieve good blends. Thus, the outcome of the blend is very dependent on the skill of the person doing the blending. The solvent evaporation method can also be very dangerous. Fire and explosion have occurred during the solvent evaporation blending process. The operator is in close proximity to the mixing and granulation process, a high risk situation. The evaporation method is also time intensive, requiring several hours per blend.

The preparation of propellants has also been done using a precipitation technique. In this method, the fuel and oxidizer components are suspended in the binder solution by a mechanical mixer and a countersolvent is added while mixing the solution. The countersolvent causes the binder to precipitate from the solvent. As the binder precipitates, the active particles are entrapped in the binder. This process has historically been a manual operation with the operator in close proximity to the mix container, adding the dry components and countersolvent. The timing of process events lacked a degree of repeatability due to the human operator. Previous attempts to use the precipitation methodology for the preparation of propellants resulted in poor repeatability. These blends have suffered from rubbery inclusions, or the formation of clay-like products that require granulation similar to the evaporation process. Fire and explosion have also occurred during the precipitation blending process. These incidents have usually been due to pyrophoric or static discharge ignition of the metal fuel component. The operator has also been at risk in close proximity to the mixing process which involves the use of volatile, flammable solvents, as well as the propellant particles.

From the descriptions above it is evident that the largest factor reducing personnel safety is close proximity to the blending operation. The ability to perform the blending operation from a remote location would greatly increase safety. It would be desirable to have an automated propellant blending system in which the quality and characteristics of the propellant composition are not so dependent upon the skill of the human blending operator. It would also be desirable to speed up production and expand the capacity of propellant manufacturing facilities. It would be further desirable to have available a propellant blending system which avoids the evaporation method and the safety hazards incidental to drying the propellant composition to dryness. It would also be desirable to use a propellant blending process which minimizes the screening requirement and obtains a finer end product than has been available heretofore. Ideally, an automated propellant blending system would be able to produce agglomerated propellant particles having a controlled particle size distribution.

SUMMARY OF THE INVENTION

We have invented an automated propellant blending system using a closely metered addition of a countersolvent to a solution of binder with fuel, oxidant and other particles suspended therein to achieve a precise precipitation rate of the binder during a precipitation cycle. By establishing a profile of binder precipitation versus the ratio of countersolvent to solvent, for example, using ordinary laboratory equipment to precipitate fixed amounts of binder solution and various countersolvent-solvent ratios and temperatures, a curve and/or computer algorithm can be derived to precisely control countersolvent addition near the cloud point or coacervation point to obtain a controlled rate of precipitation of the binder into the mix. This assures a continuous, predictable release of binder precipitate into the mix container for a controllable transition of the properties of the binder during agglomeration and finishing of the propellant composition particles. The system can include remote, computer-controlled precipitation for safety, reliability and improved product properties.

In one aspect, the present invention provides a method for preparing a solid propellant mixture of oxidant and fuel particles in a binder. The method includes the steps of:

(a) admixing solid particles in a solution of binder;

(b) adding countersolvent to the admixture of step (a) to about a coacervation point while maintaining agitation;

(c) metering countersolvent under controlled conditions of shear into the mixture of step (b) to precipitate the binder and form aggregated particles, wherein the countersolvent metering rate and shear rate are matched to obtain a desired particle size distribution of the aggregated particles;

(d) admixing excess countersolvent into the mixture from step (c), preferably at a higher countersolvent addition rate relative to step (c), while maintaining conditions of shear;

(e) maintaining agitation of the mixture from step (d) for a period of time to allow the binder in the aggregated particles to harden;

(f) rinsing the hardened aggregated particles from step (e) with additional countersolvent.

The method is particularly applicable to the preparation of metal powder/oxidant/polymer propellant blends, especially zirconium-potassium perchlorate propellant blends using a fluorinated elastomer such as a terpolymer of hexafluoropropylene, vinylidene fluoride and tetrafluoroethylene. The method can also be used to coat any particles in general with a polymeric binder. For example, the method can be used to coat metallic particles to inhibit air oxidation during storage.

Steps (a) and (b) preferably include charging a mixing container with the binder solution, fuel particles, optional processing aids such as graphite and a countersolvent preload, mixing the contents of the mixing container, and while maintaining mixing of the mixing container, adding a charge of oxidant particles to the mixing container. The addition of the oxidant particle charge, as well as the countersolvent addition and hardening of the aggregated particles, can be remotely actuated to facilitate personnel safety.

In a preferred embodiment, the method includes empirically determining the coacervation point for the countersolvent-solvent system as a function of temperature. Based on this empirical determination, the countersolvent ratio of the coacervation point relevant to step (b) is estimated. Step (b) preferably includes the sequential steps of adding a preload of countersolvent to avoid coacervation, preferably to within about 20 percent of the countersolvent-solvent ratio at the coacervation point, allowing the admixture to thermally equilibrate, measuring the temperature of the admixture, calculating the countersolvent-solvent ratio needed for coacervation at the measured temperature, and adding additional countersolvent to the mixture to make the calculated ratio of countersolvent to solvent.

The countersolvent metering ratio in step (c) is different from a ratio of countersolvent addition in step (b), typically slower in step (c) relative to step (b) to avoid precipitating the binder too quickly. In step (c), the countersolvent metering can be stopped and shearing of the mixture maintained for a period of time effective to aggregate the particles to the desired particle size distribution while the particles have a tendency to stick together, prior to adding the excess countersolvent and hardening the aggregated particles in steps (d) and (e).

The rinsing step (f) can desirably include stopping agitation of the mixture and allowing the aggregated particles to settle, decanting supernatant, and adding additional countersolvent.

In another aspect, the present invention provides apparatus for manufacturing a solid propellant mixture of oxidant and fuel particles in a binder. The apparatus includes a mixing container, a variable-speed impeller, a countersolvent supply system, a decanting line and a control system. The impeller is provided for agitating a mixture of binder, solvent and solid particles in the mixing container. The countersolvent supply system is provided for adding countersolvent into the mixing container. The decanting line is provided for removing supernatant liquid from the mixing container. The control system is capable of adjusting the speed of the impeller, adjusting the rate of countersolvent addition and actuating liquid removal from the mixing container through the decanting line. The control system preferably includes a countersolvent metering routine for effecting the steps of: (1) adding the countersolvent to the mixing container with operation of the mixing impeller up to about a coacervation point, (2) at about the coacervation point, matching the countersolvent addition rate and impeller speed to obtain a desired particle size distribution of the particles aggregated with the binder, and (3) thereafter adding excess countersolvent to the mixing container, preferably by increasing the countersolvent addition rate. The control system also preferably includes a liquid removal routine for stopping the impeller, allowing particles to settle in the mixing container and actuating a valve in the decanting line to remove supernatant liquid from the mixing container.

The countersolvent supply system preferably includes relatively high and low countersolvent flow modes. In one embodiment, the countersolvent supply system includes first and second parallel flow paths. The first flow path is sized for a relatively rapid flow of countersolvent relative to a flow resistance of the second path. The second path is generally used for the countersolvent addition during step (2) in the countersolvent metering routine. In an alternate embodiment, a single valve in a flow path is operable for the high countersolvent flow mode in a continuously open position, and capable of being pulsed open and closed at a frequency selected to provide a desired low countersolvent flow mode rate.

The apparatus preferably includes a weight sensor for measuring changes in the weight of the mixing container. The liquid removal routine can include a comparison of the mixing container weight before and after actuation of the valve to confirm removal of the supernatant liquid. The control system preferably includes a final countersolvent addition routine for adding additional countersolvent to the mixing container after execution of the liquid removal routine, comparing the mixing container weight before and after the additional countersolvent addition to confirm the countersolvent addition, and stirring the mixing container with the impeller.

The apparatus also preferably includes a temperature sensor such as a thermocouple for measuring the temperature of the mixing container. Step (1) of the countersolvent metering routine can include adding a preload of countersolvent to within about 20 percent of the coacervation point, measuring the temperature of the mixing container, calculating the countersolvent-solvent ratio of the coacervation point at the measured temperature, and adding additional countersolvent to the mixing container to make the calculated ratio of countersolvent to solvent.

The apparatus can also include a dump mechanism which is remotely actuatable to add a supplemental charge of particles to the mixing container, for example, oxidant particles. The countersolvent supply system preferably includes a tank including a charge of countersolvent. The apparatus can also include a charge of fuel particles in a binder solution in the mixing container. Preferably the fuel is zirconium, the oxidant is potassium perchlorate and the binder is fluoroelastomer.

BRIEF DESCRIPTION OF THE DRAWINGS

FIG. 18 is a graph of the coacervation point of the countersolvent-solvent ratio of Viton B fluoropolymer in acetone and heptane at a loading of 20 g/700 ml.

DETAILED DESCRIPTION

Figure 4B:
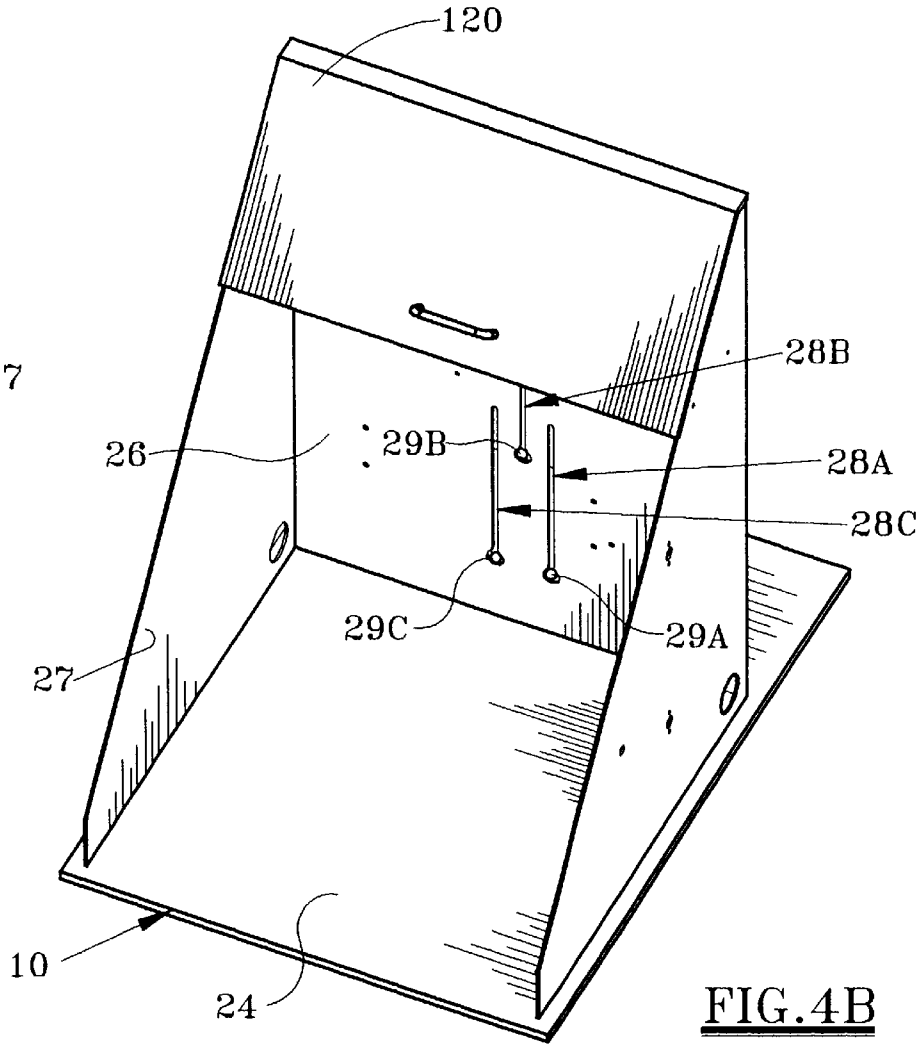
FIGS. 4A and 4B are perspective front and rear views, respectively, of the chassis assembly of the propellant blending system of FIG. 1.

With reference to the accompanying drawings wherein like numerals are used to designate like parts, in one embodiment taking advantage of the principles of the present invention, a propellant blending system is provided in the form of a generally self-contained chassis assembly 10 on which are mounted container assembly 12, platform assembly 14, motor assembly 16, dump mechanism 18, countersolvent supply system 20 and dip tube 22. Chassis assembly 10 (see FIGS. 4A and 4B) includes a horizontal base 24, vertical partition 26 and opposite side-wall supports 27. The components of the propellant blending system are generally mounted on the vertical partition 26, as will be described in more detail below, with appropriate connections for the supply of electricity, instrument air, nitrogen, countersolvent and the like as necessary. Vertical slots 28A,28B and 28C with enlarged lower ends 29A,29B,29C are formed in the partition 26 for receiving respective lugs 30A, 30B and 30C on container assembly 12 (see FIG. 6) for vertically positioning the container assembly 12.

Figure 1:
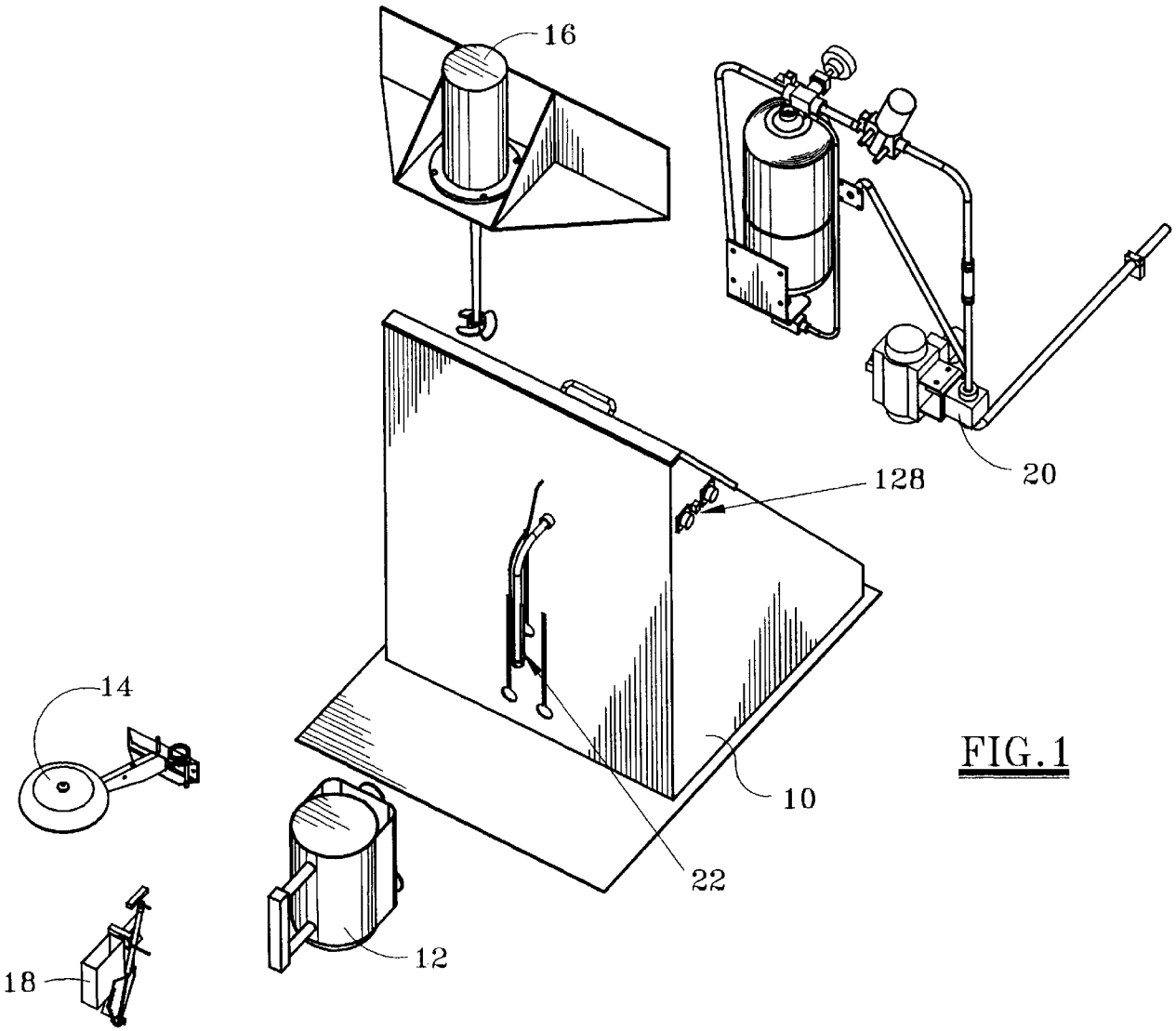
FIG. 1 is an exploded view of an embodiment of the propellant blending system according to the present invention.
Figure 2:
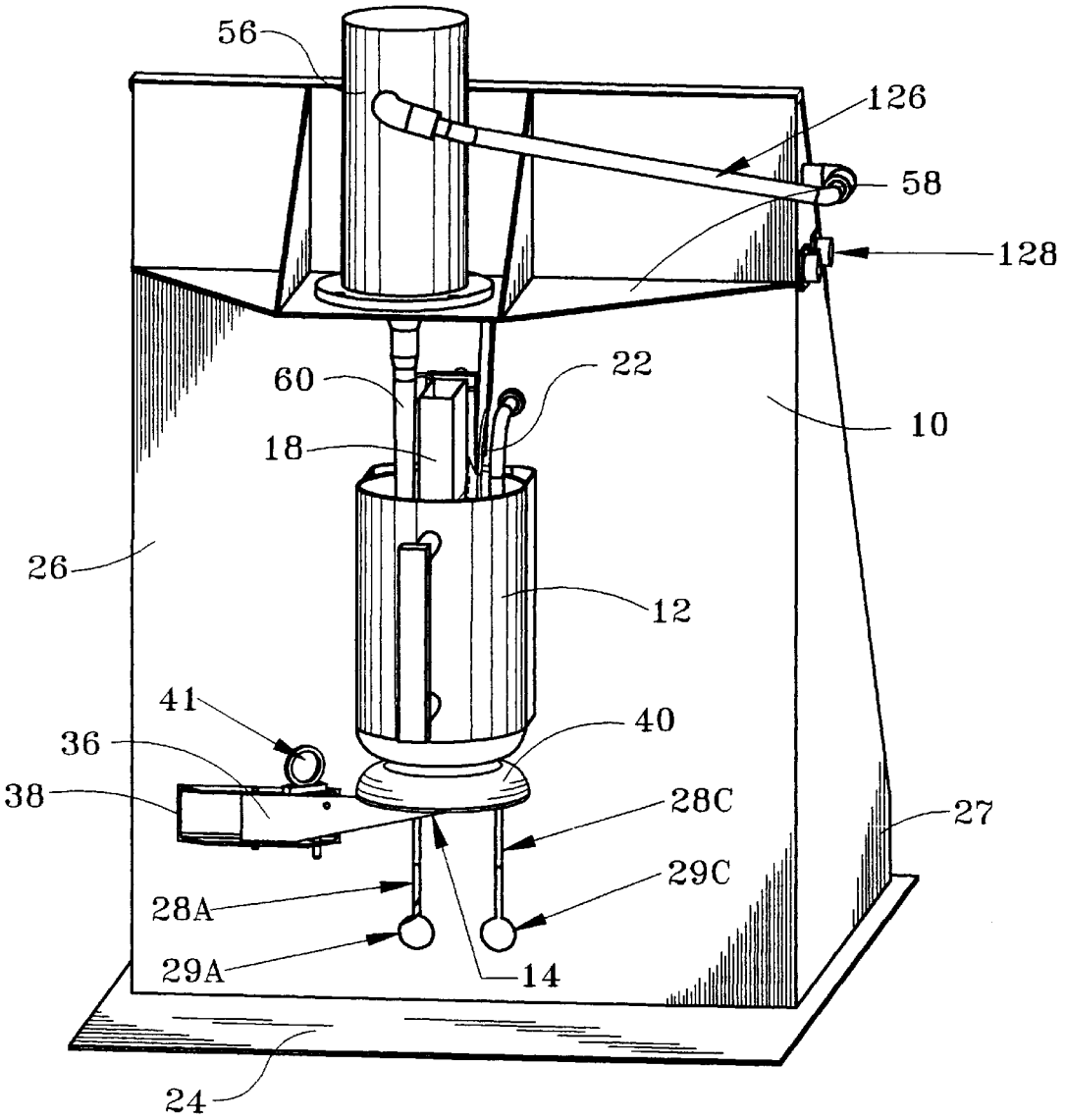
FIG. 2 is a perspective front view of the blending system of FIG. 1.
Figure 5:
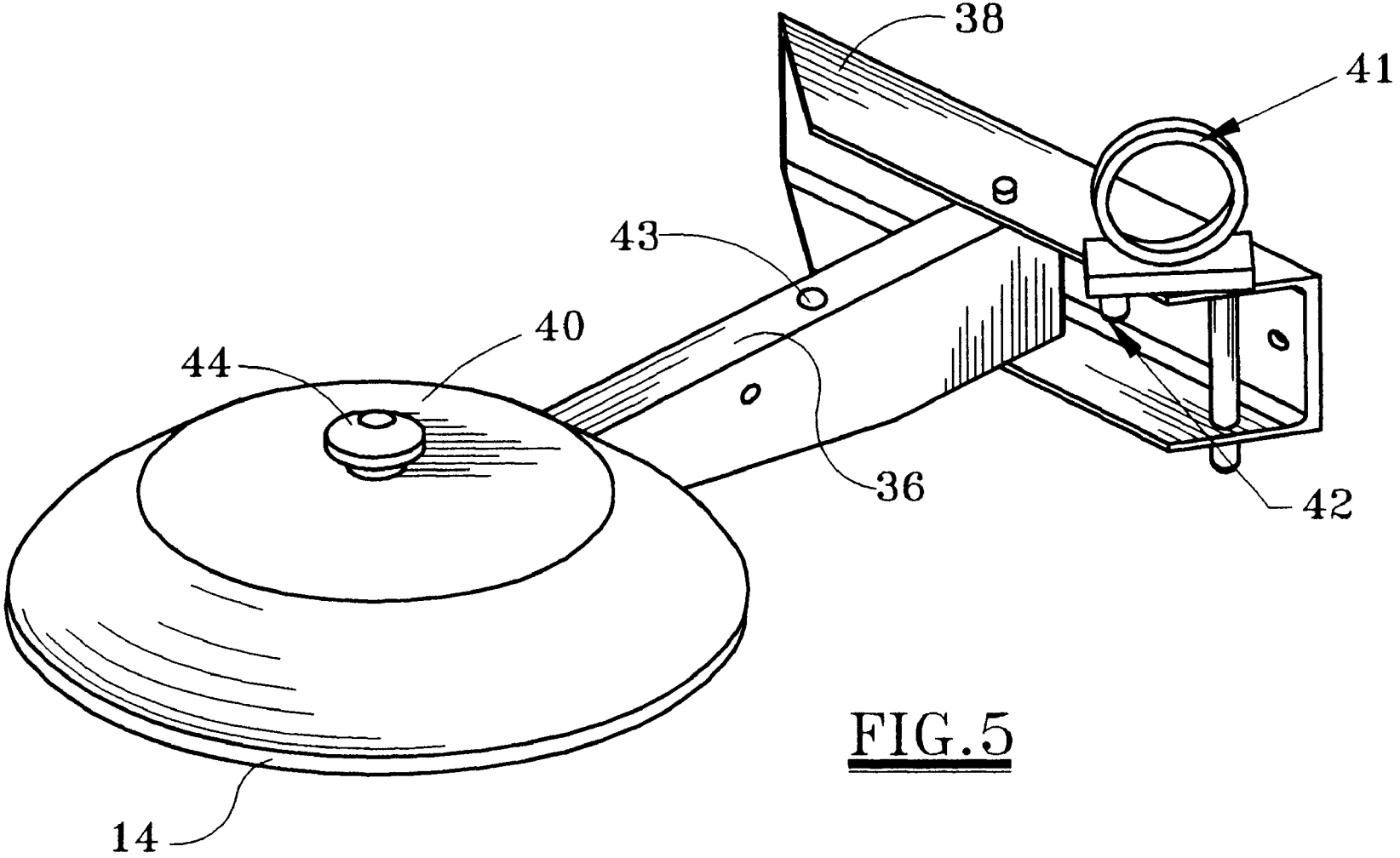
FIG. 5 is a perspective view of the platform assembly of the propellant blending system of FIG. 1

As best seen in FIG. 5, the platform assembly 14 includes a hinged arm 36 secured to the partition 26 by means of bracket 38. The arm 36 is fixed vertically and swings in a horizontal direction to position a support 40 secured at an outer end thereof underneath the container assembly 12 (see FIG. 2). A spring-biased pin assembly 41 mounted in the bracket 38 has a pin 42 receivable in a bore 43 formed in the arm 36 for locking the arm 36 in position to support the container assembly 12. The support 40 can include a load cell 44 for measuring the weight of the container assembly 12 and the contents thereof. Thus, the container assembly 12 is supported on the support 40 for operation of the propellant blending system, but can be removed by removing the pin 42 from the bore 43 and pivoting the arm 36 outwardly to remove the support 40 to allow the container assembly 12 to be moved downwardly by sliding the lugs 30A,30B,30C in the respective slots 28A,28B and 28C.

Figure 6:
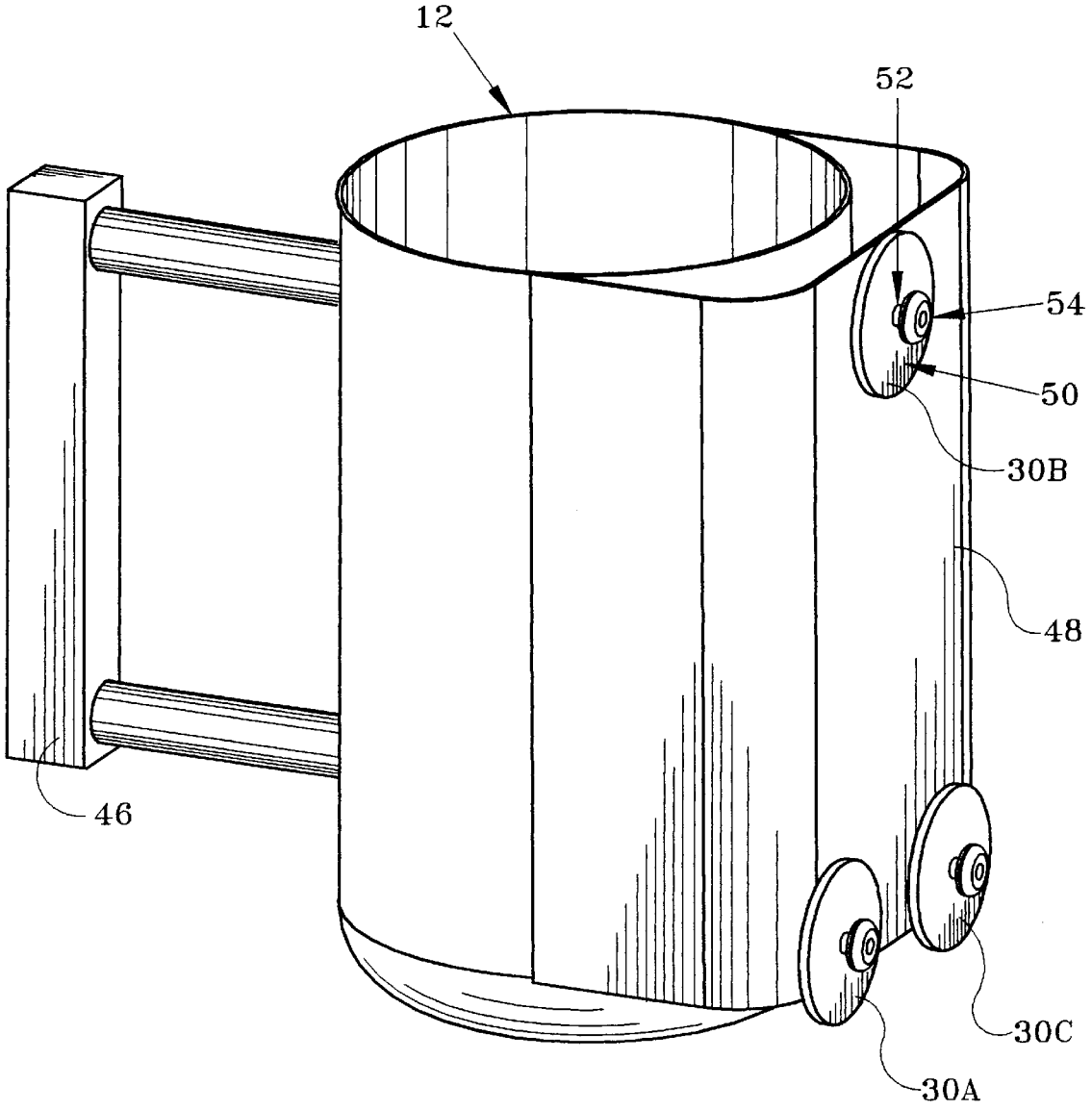
FIG. 6 is a perspective view of the container assembly of the propellant blending system of FIG. 1.

As best seen in FIG. 6, the container assembly 12 is generally cylindrical with an open top and provided with a handle 46 on one side thereof. On the opposite side, a mounting armature is affixed and includes a generally vertical plate 48 to which the lugs 30A,30B,30C are mounted. The lugs 30A,30B,30C generally include a base 50 welded or bolted to the vertical plate 48, axle 52 extending outwardly therefrom, and terminating with an enlarged head 54. The lugs 30A,30B,30C are generally spaced apart laterally to correspond with the spacing between the slots 28A,28B, 28C, and at least one of the lugs is preferably offset vertically, as lug 30B, for example. The lugs 30A,30B,30C are generally arranged so that the pattern thereof corresponds with the pattern of the open ends 29A,29B,29C of the slots 28A,28B,28C. The axles 52 have a diameter or width which is less than that of the corresponding slots 28A,28B, 28C. Each head 54 has a diameter which is larger than the respective slot 28A,28B,28C, but smaller than the enlarged ends 29A,29B,29C.

Figure 7:
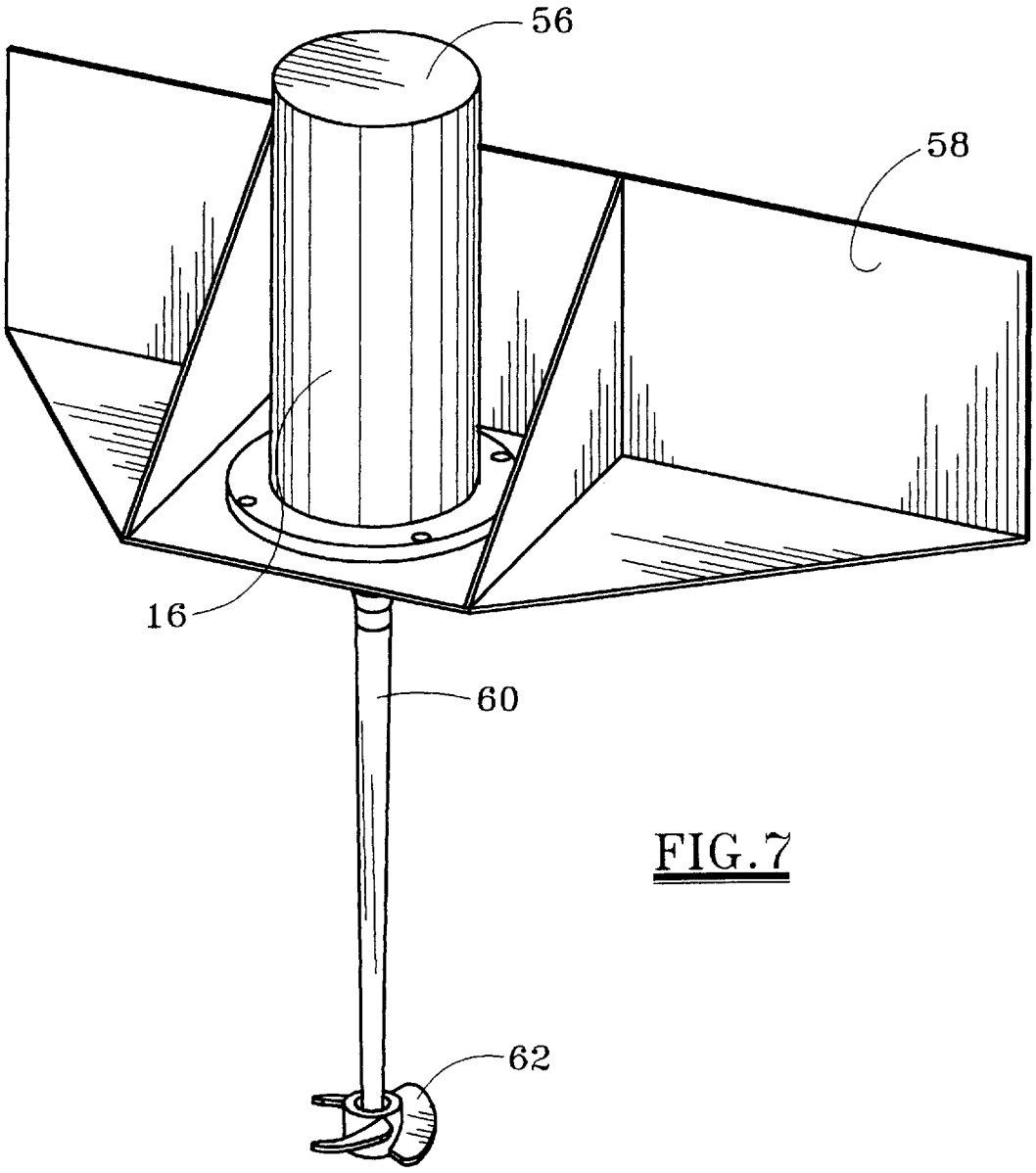
FIG. 7 is a perspective view of the motor assembly of the propellant blending system of FIG. 1.
Figure 8:
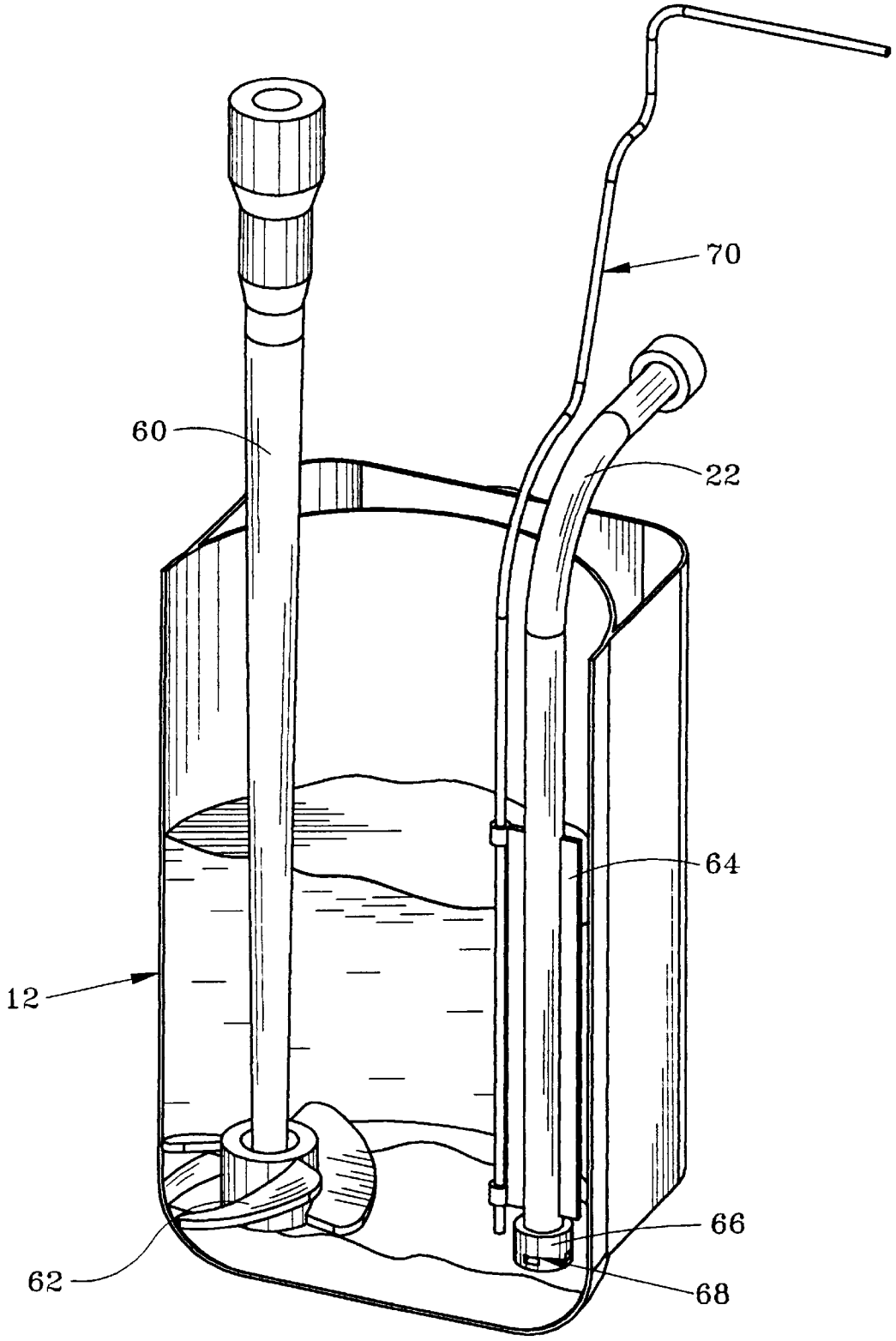
FIG. 8 is a perspective view of the container assembly, cut away to show the impeller, dip tube, liquid level and settled particles in the propellant blending process using the apparatus of FIG. 1.

As best seen in FIG. 7, the motor assembly 16 includes a motor 56 which can be mounted to the partition 26 (FIG. 2) by means of bracket 58. For use with flammable solvents and/or reactive particles, the motor 56 should be explosion proof. A shaft 60 depends from the motor and has a propeller 62 attached at a lower end thereof. As seen in FIG. 8, the motor assembly 16 is mounted on the partition 26 so that it is positioned to stir the contents of the container assembly 12. The countersolvent dip tube 22 passes horizontally through the partition 26 and downwardly for sufficient length to terminate above a bottom of the container assembly 12. The dip tube 22 is desirably shaped to function as a baffle in the mixing container 12, for example, with blades 64 extending laterally on either side thereof. The dip tube 22 preferably terminates at cap 66 provided with radially spaced slots 68 to minimize mixing between the contents of the container assembly 12 and countersolvent inside the dip tube 22. If desired, thermocouple 70 can be affixed to the dip tube 22, preferably on one of the blades 64.

Figure 9:
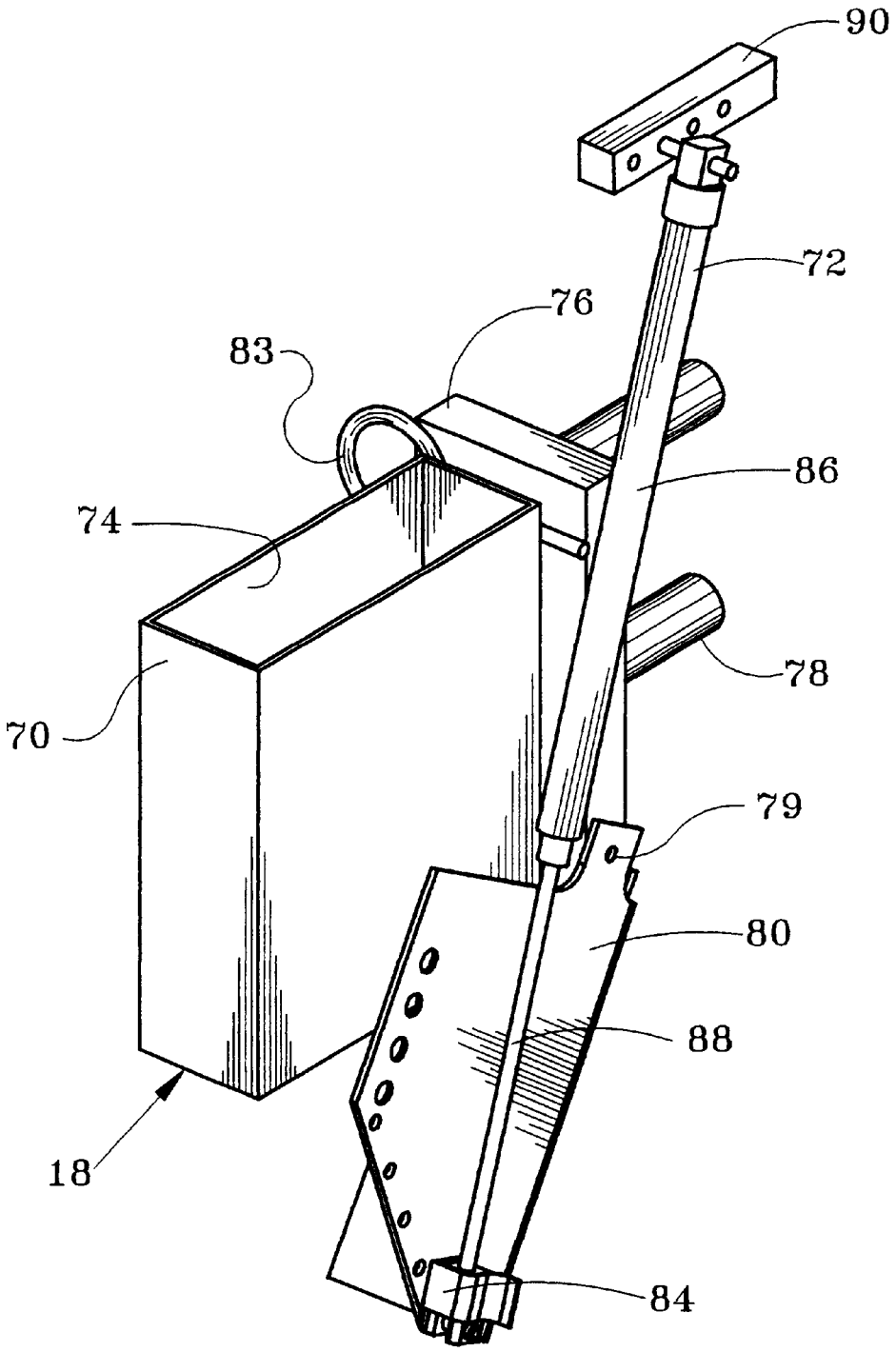
FIG. 9 is a perspective view of the dump mechanism of the propellant blending system of FIG. 1, shown in the open position.
Figure 11:
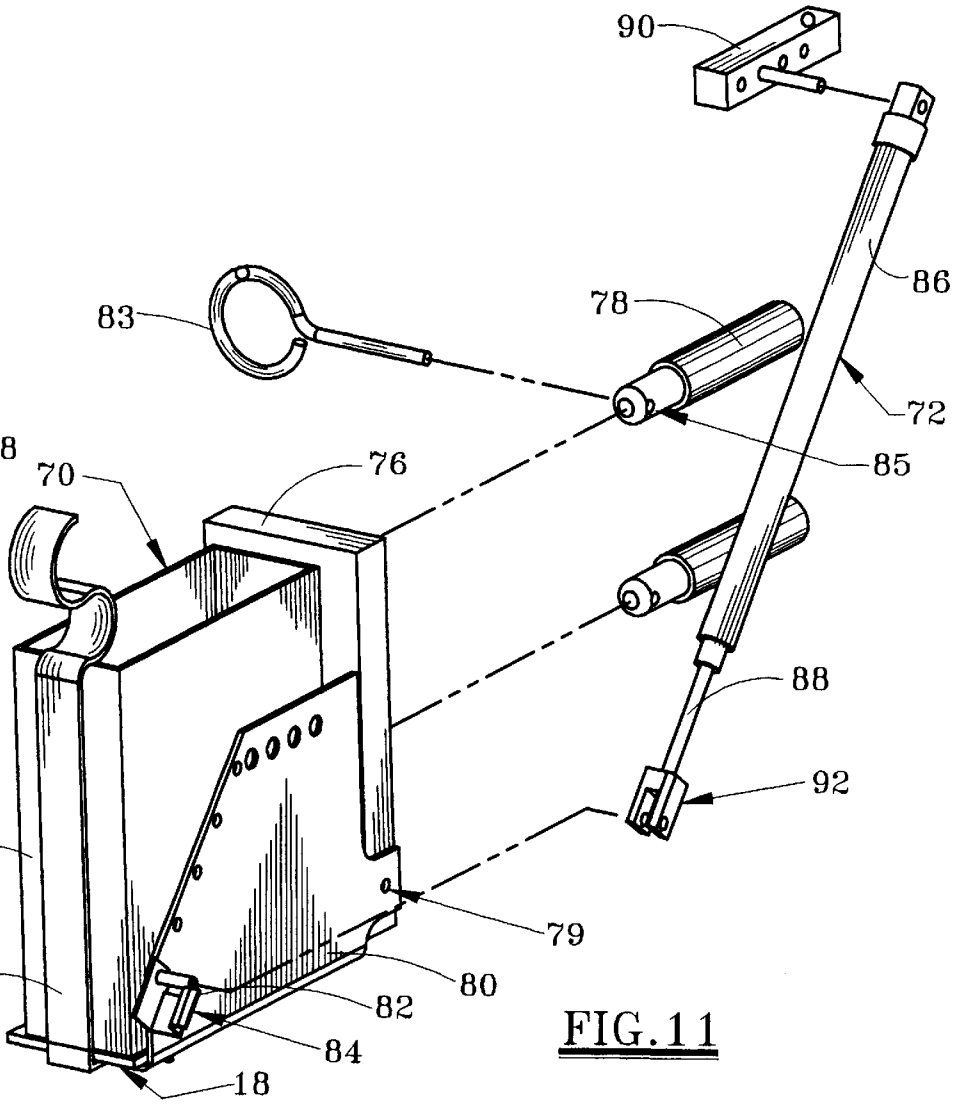
FIG. 11 is an exploded view of the dump mechanism of FIG. 9.
Figure 10:
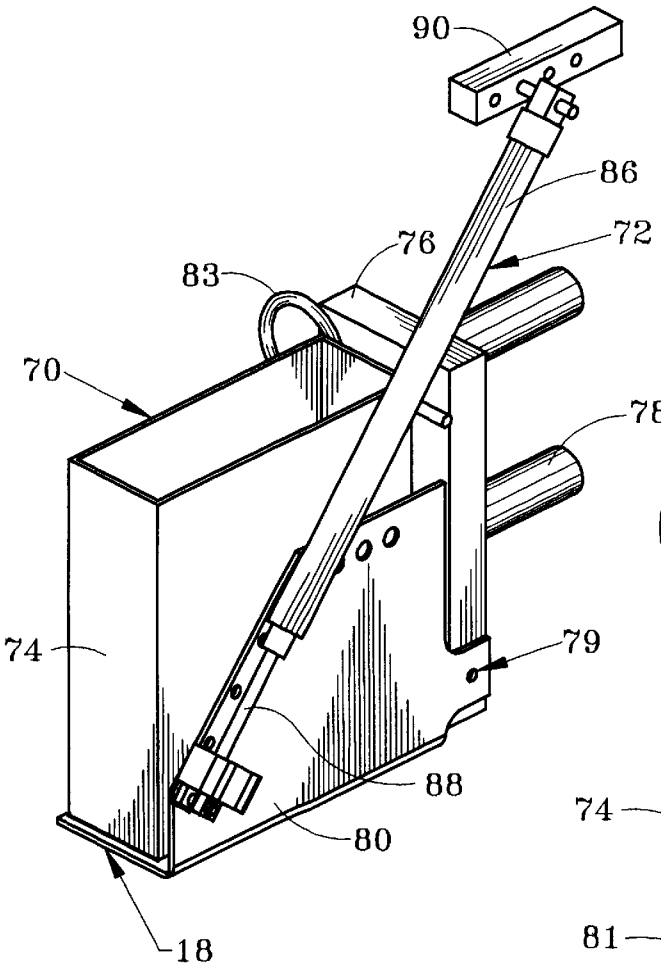
FIG. 10 is a perspective view of the receptacle assembly of the dump mechanism of FIG. 9, shown in the closed position.

The dump mechanism 18 mounts adjacent the container assembly 12 for adding the oxidant particles thereto by remote actuation. As shown in FIG. 9, the dump mechanism 18 includes receptacle assembly 70 and actuation lever 72. The receptacle assembly 70 includes chute 74 affixed on one side to mounting plate 76 and spaced therefrom, and spring-biased mounting pins 78 which pass through respective bores (not shown) formed in the mounting plate and extend from an opposite side of the mounting plate 76 for attachment to the partition 26. The receptacle assembly 70 is detachable from the chassis assembly 10 and actuation lever 72 for charging with oxidant particles, for example. While detached, a retaining clip 81 is used to hold a lower gate 80 in a closed position as seen in FIG. 11. The lower gate 80 is hingedly connected at 79 to a lower end of the mounting plate 76 for selectively opening and closing a bottom of the chute 74. The receptacle assembly 70 is removably attached to the partition 26 by means of the mounting pins 78 and keeper 83. The keeper 83 is engaged in transverse bore 85 formed near an end of the mounting pins 78 between the mounting plate 76 and chute 74 (see FIGS. 10 and 11). The gate 80 has a lateral pin 82 and clip 84 rotatably secured thereto for removable attachment to the actuation lever 72.

Figure 9A:
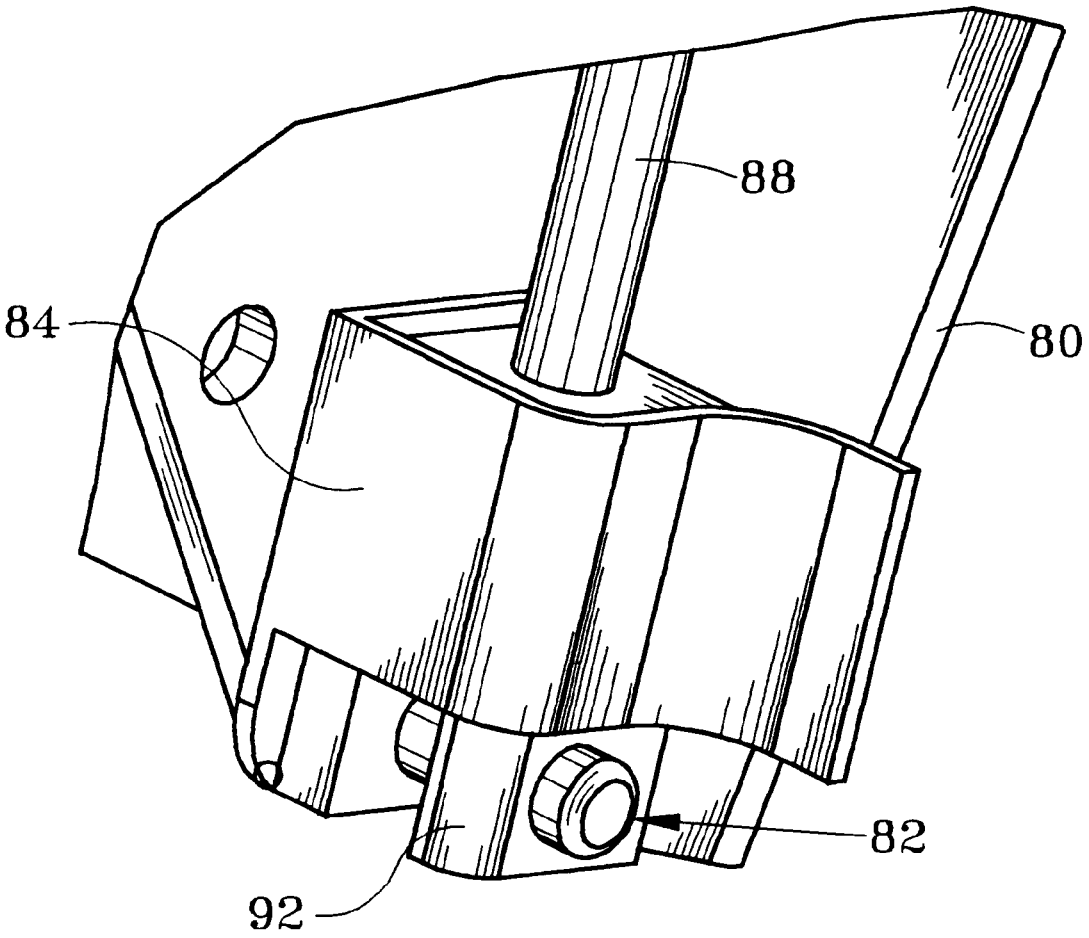
FIG. 9A is an enlarged detail of the dump mechanism of FIG. 9.

The actuation lever 72 includes a cylinder 86 housing a pneumatically operable piston (not shown) connected to a shaft 88. The cylinder 86 has a proximal end rotatably secured to the partition 26 via bracket 90. The shaft 88 has distal end 92 with a transverse bore 85 (see FIG. 9A) for slideably and rotatably receiving lateral pin 82. The distal end 92 has a profile adapted to be received in the clip 84.

Figure 2A:
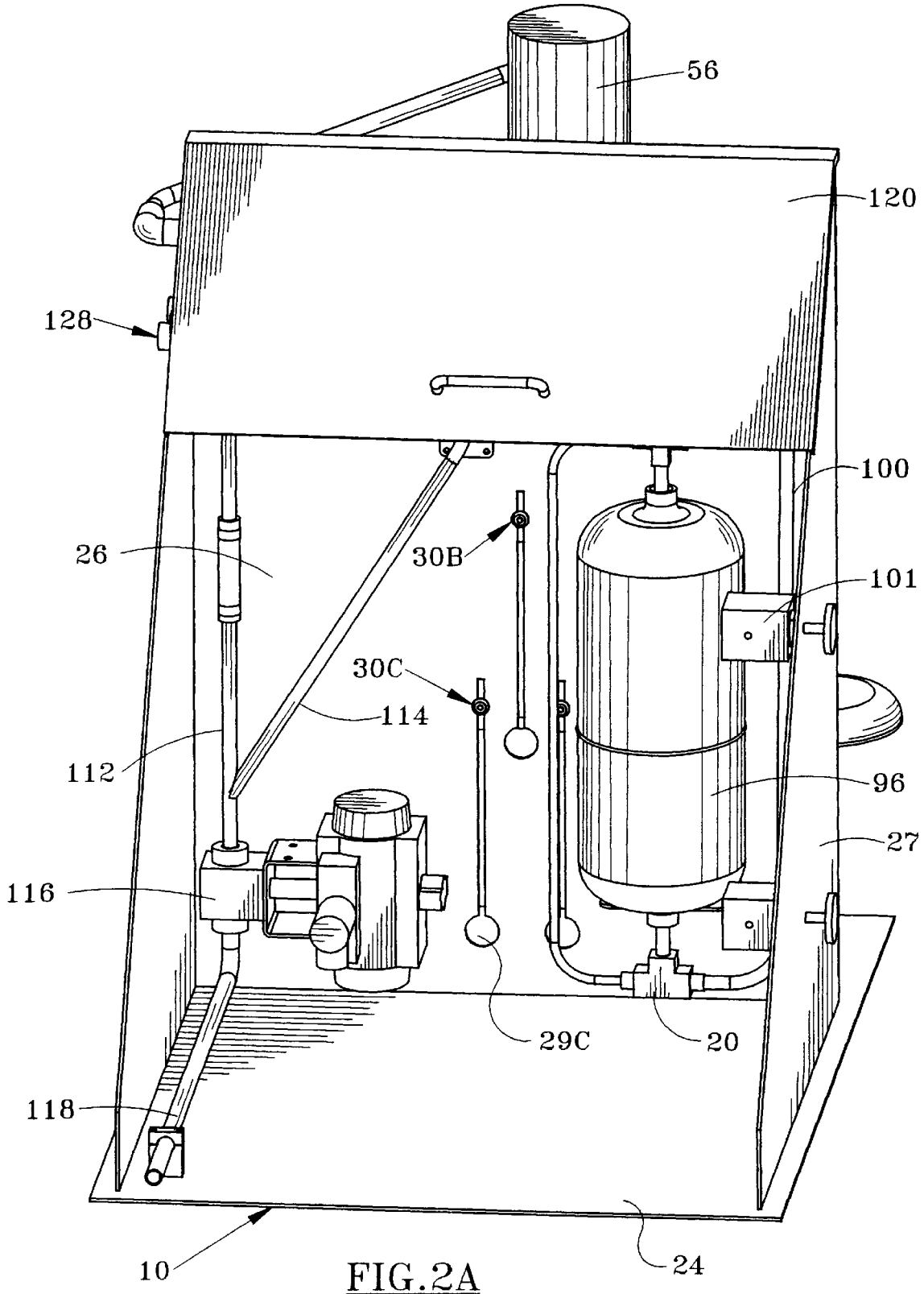
FIG. 2A is a perspective rear view of the blending system of FIG. 2.
Figure 3:
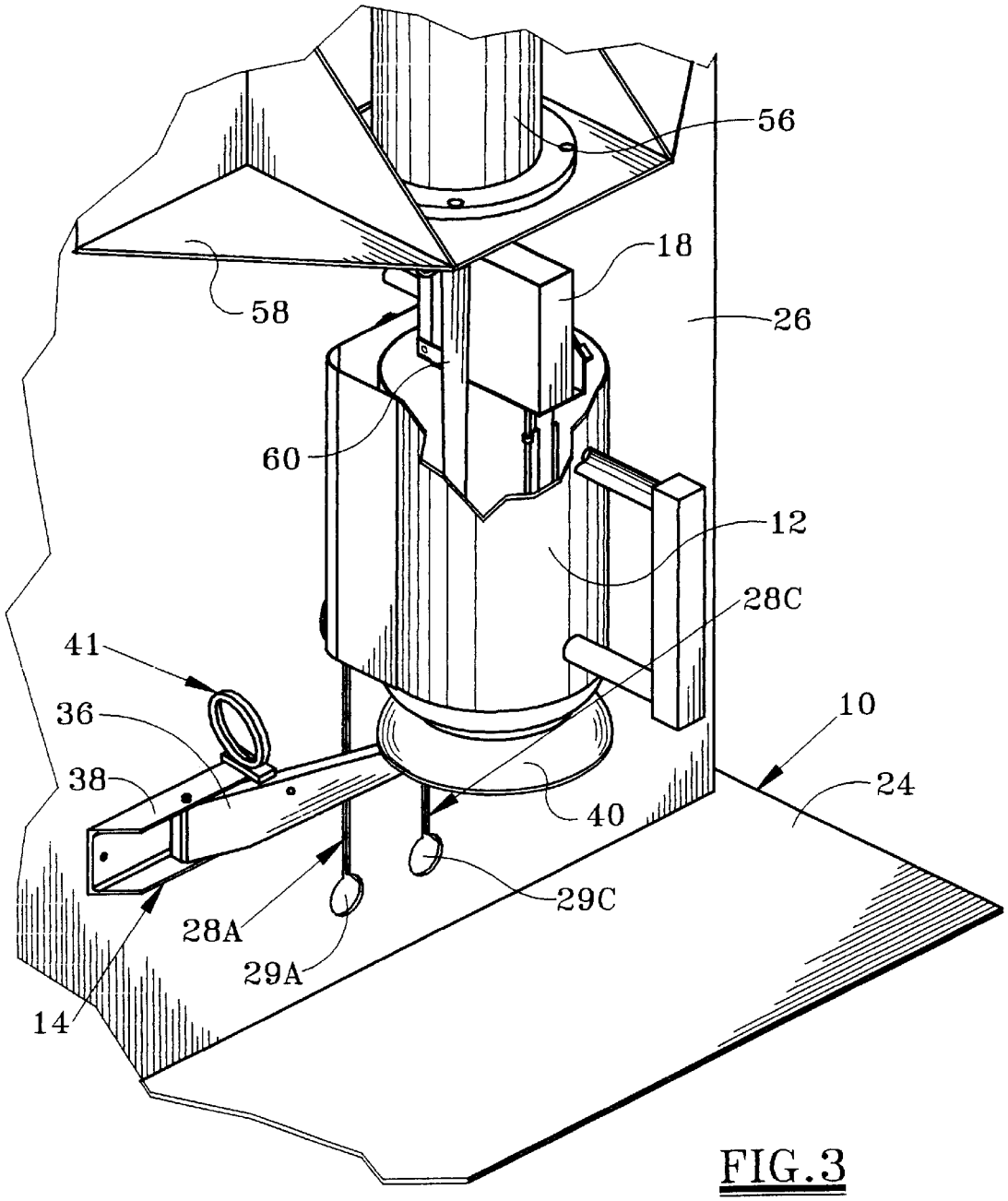
FIG. 3 is an enlarged perspective front view, with the container assembly partially cut away to show the dump mechanism, of a portion of the blending system of FIG. 2.
Figure 12:
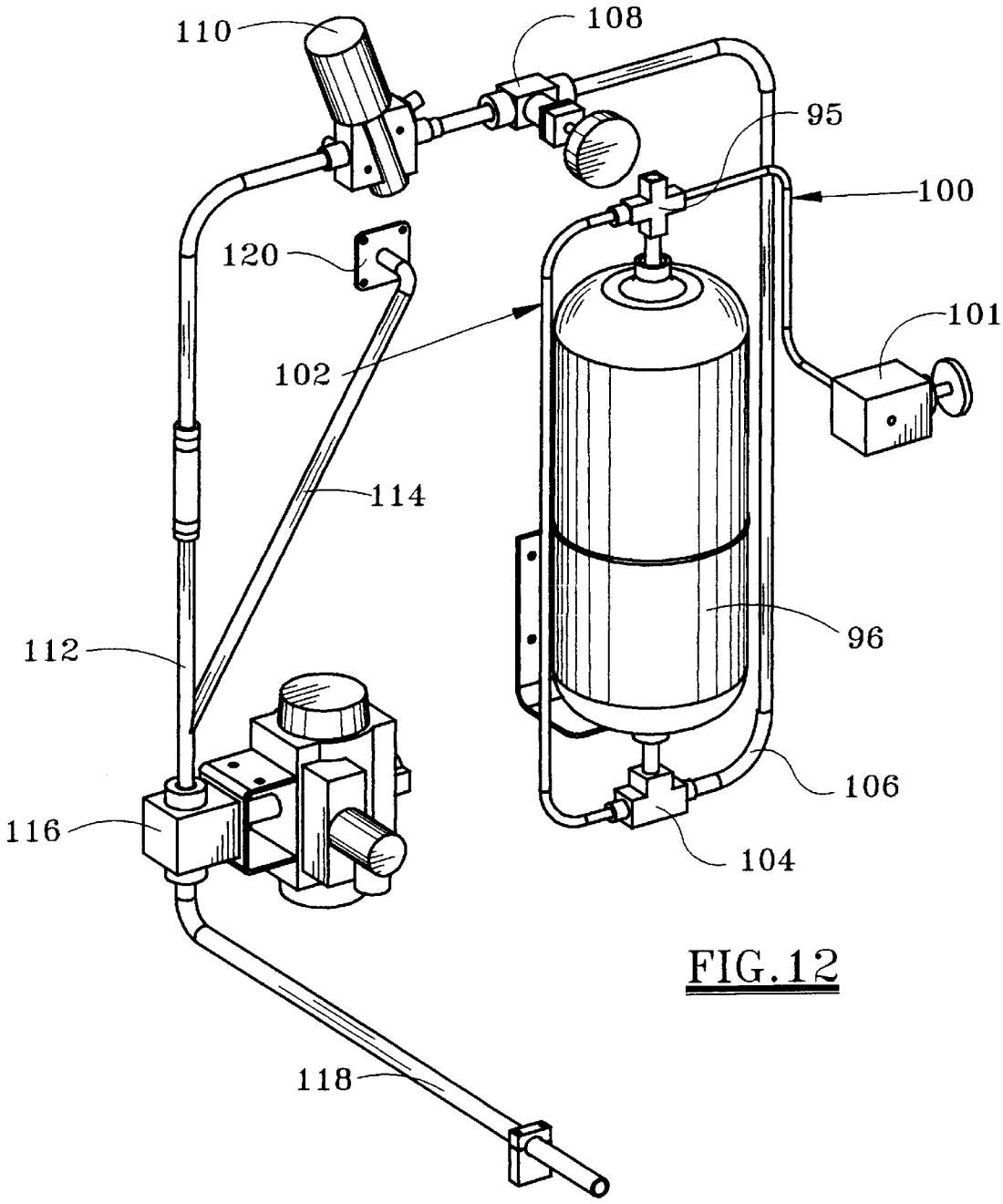
FIG. 12 is a perspective view of the countersolvent supply system of the propellant blending system of FIG. 1.

As seen in FIG. 2A, the countersolvent supply system 20 is mounted on the reverse side of the partition 26. As shown in FIG. 12, the countersolvent supply system 20 includes a tank 96 connected to a cross 98. One port in the cross 98 is available for re-supplying countersolvent to the tank 96. A line 100 supplies nitrogen or other inert gas from pressure regulator 101 to the top of the tank 96 at cross 98. A sightglass 102 or other level indicator, is provided by connection at upper and lower ends of the tank 96, for example, via cross 98 and tee 104.

Countersolvent is supplied to the dip tube 22 from tank 96, through tee 104, line 106, hand valve 108, solenoid valve 110, gravity leg 112 and decant/supply line 114. The pressure regulator 101 maintains a uniform pressure in the tank 96. Hand valve 108 has an adjustable orifice to establish a maximum countersolvent flow rate. The solenoid valve 110 is capable of continuous operation to supply the countersolvent at the maximum flow rate limited by the setting of the hand valve 108, and can also be pulsed at different duty cycles to deliver countersolvent at a lower, precisely controlled flow rate. A suitable solenoid valve 110 is commercially available, for example, a ½-inch Marrofta solenoid valve.

The gravity leg 112 is connected to a decant valve 116 positioned at a low point relative to the bottom of the dip tube 22 to establish a siphon from the container assembly 12 into waste line 118. The decant/supply line 114 extends upwardly from the gravity leg 112 adjacent the decant valve 116 and passes through the partition 26 at fitting 120 to connect to the dip tube 22 on the opposite side thereof. During countersolvent delivery, the decant valve 116 is closed. The valve 116 is opened pneumatically when it is desired to decant liquid from the container assembly 12.

Figure 13:
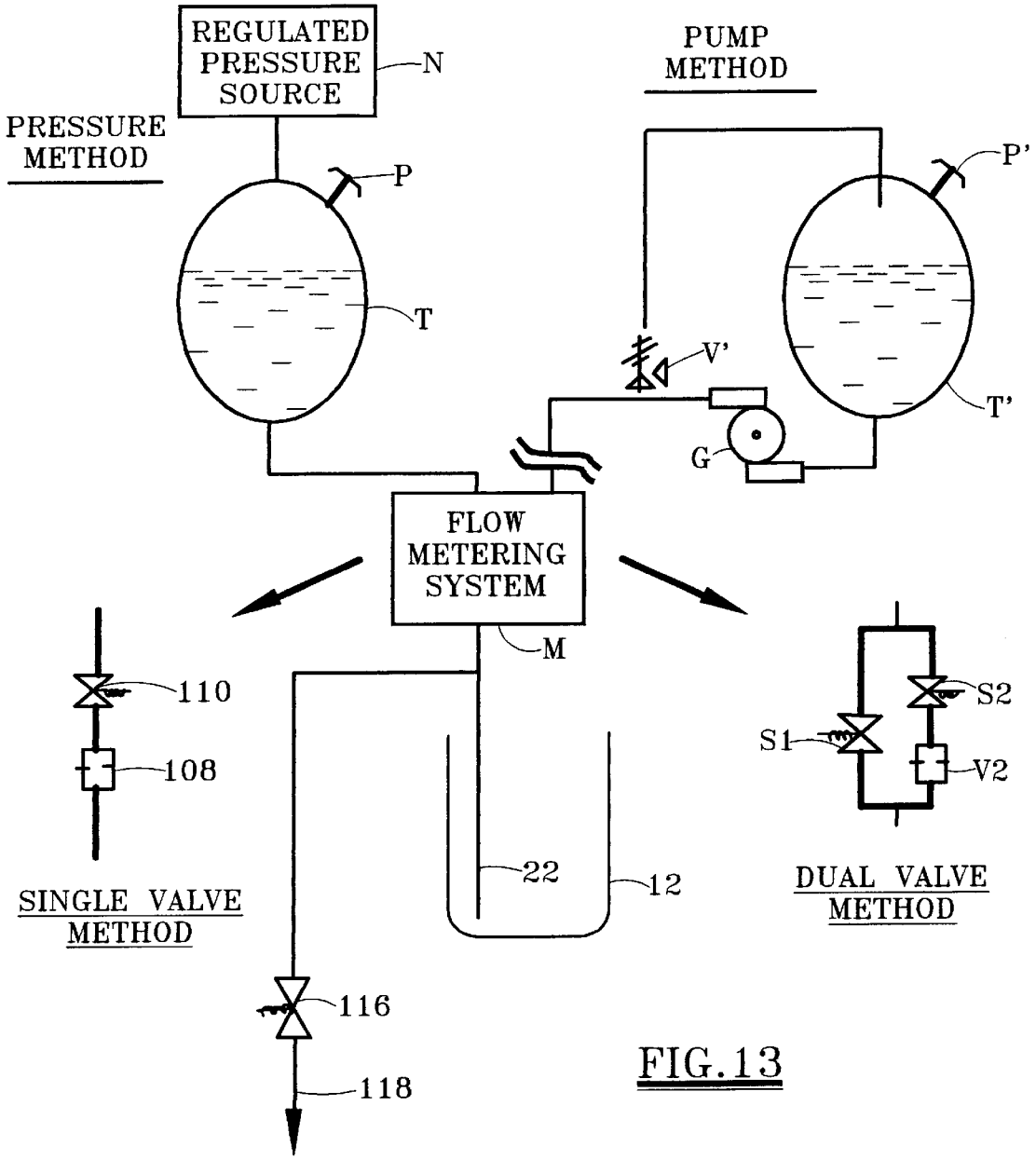
FIG. 13 is a schematic diagram showing alternative countersolvent supply methods for the propellant blending system of the present invention.

With reference to FIG. 13, some examples of alternate countersolvent supply and flow metering embodiments are schematically indicated. In the apparatus just described for the pressure method, a regulated pressure source N pads a countersolvent tank T equipped with a fill port P. In an example of a pump method as one example of an alternate embodiment, a pump G provides countersolvent from tank T' equipped with fill port P' at a constant pressure established by back relief valve V1 which returns excess countersolvent to the tank T'.

Similarly, flow metering system M can use the single valve method described above, employing solenoid valve 110 in closed position (no flow), continuously open (maximum flow) or in a pulsed operation (low, metered flow). As described above, the hand valve 108 functions as an adjustable flow limiter. In an example of a two valve method as one example of an alternate flow metering embodiment, a parallel arrangement of continuously open or closed solenoid valves S1 and S2 can be used to establish high and low countersolvent flow paths. The flow rates can be established by the trim in valve S1, for example, and/or by using an orifice plate or hand valve V2 to set fixed or adjustable flow rates. Similarly, a pump (not shown) could be used in place of decant valve 116, particularly where the line 118 is not below the liquid level in the mixing container 12 as is need to establish a siphon.

Figure 4A:
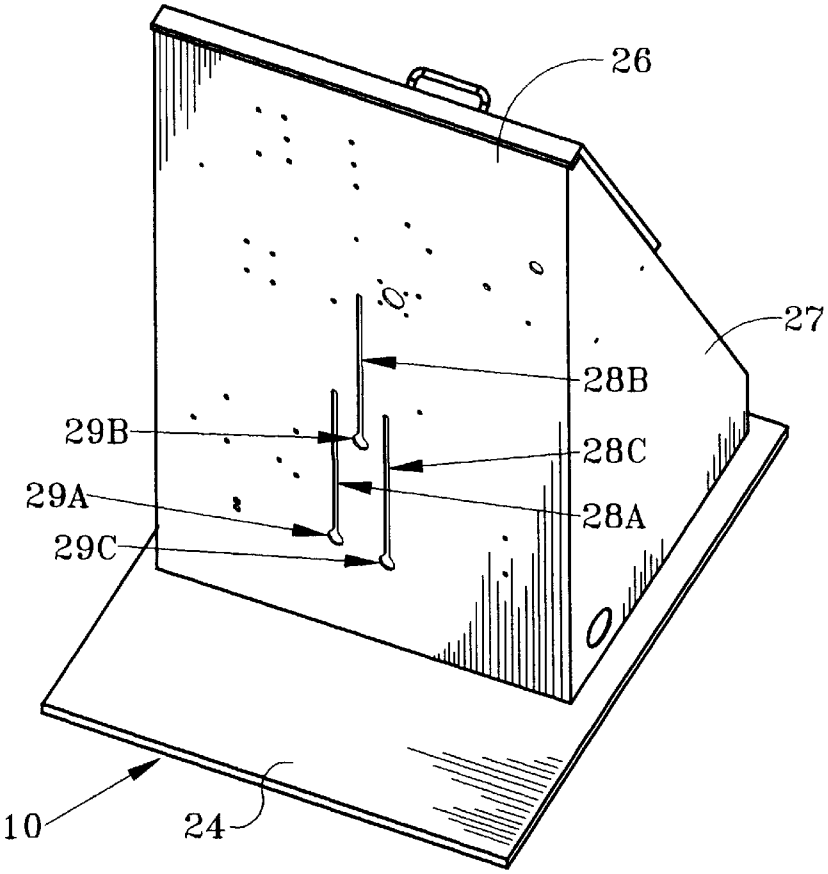

As best seen in FIG. 4A an inert gas-purged cabinet 120 can be mounted on the reverse side of the partition 26 to house the operating electronics, such as a control module (not shown) and any electrically operated valves such as solenoid valve 110. The cabinet 120 can also house electrically operated pneumatic valve 122 and vent valve 124 (see FIG. 14). An electric umbilical 126 can pass into the cabinet 120 via fitting 128 mounted in side wall 28.

Figure 14:
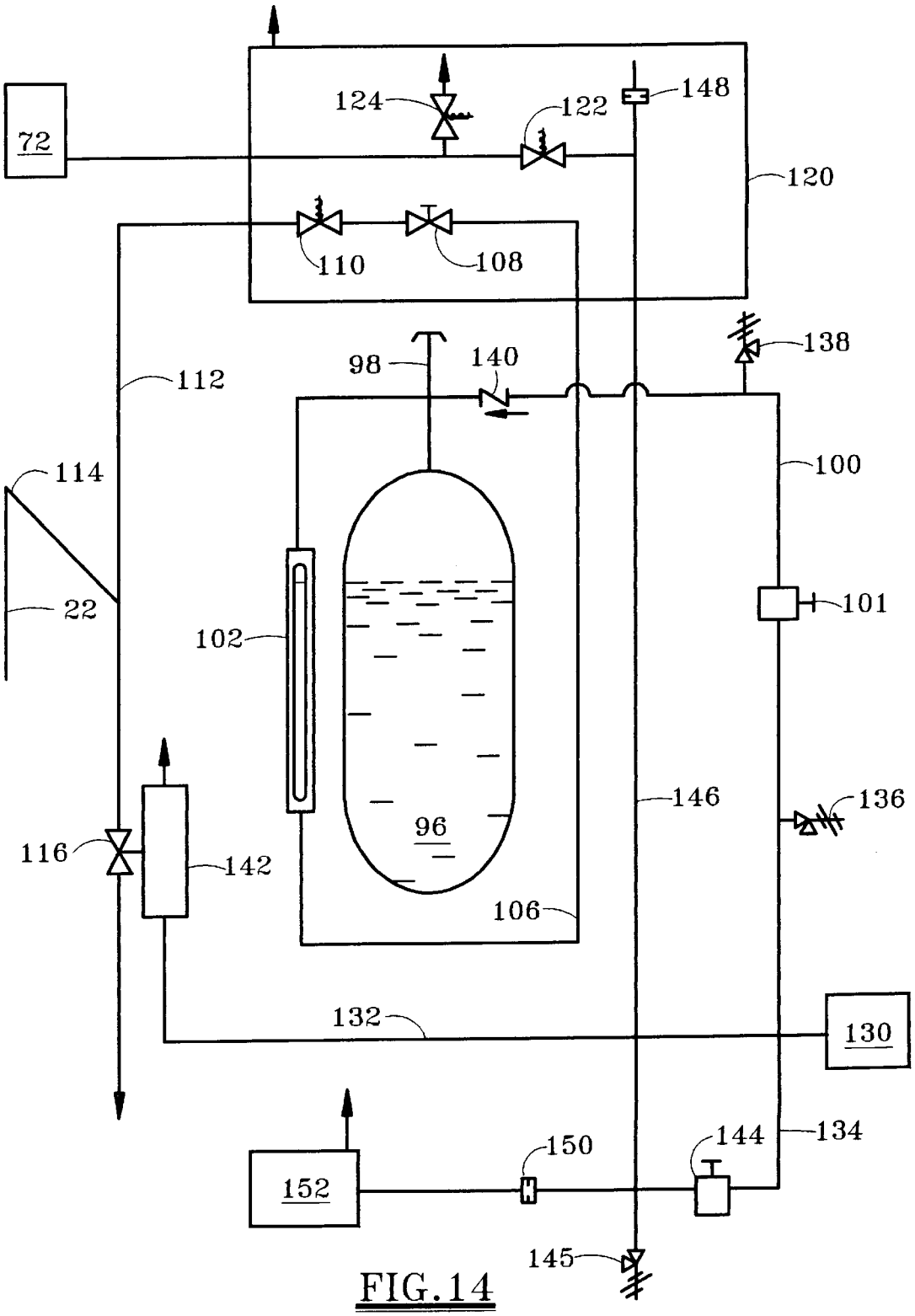
FIG. 14 is a flow schematic of the propellant blending system of FIG. 1.

An example of a suitable nitrogen supply system is illustrated schematically in FIG. 14. A high pressure nitrogen source 130, for example, a 100 psig nitrogen tank, supplies nitrogen to lines 100, 132 and 134. Line 100 includes regulator 101 mentioned above, upstream pressure relief valve 136, downstream pressure relief valve 138 and check valve 140. Regulator 101 can be hand adjustable to provide the desired pressure to tank 96, say on the order of 20 psig, for example. Relief valves 136 and 138 are designed to relieve overpressure conditions, for example, 120 psig and 25 psig, respectively, depending on system design parameters. The line 132 supplies nitrogen to actuator 142 for pneumatically operating decant valve 116.

The line 134 supplies nitrogen to regulator 144 to establish a nitrogen pressure suitable for purging the cabinet 120, for example, 50 psig. A downstream relief valve 145 protects against overpressure, for example, above 60 psig. A line 146 supplies nitrogen to orifice 148 to continuously purge the cabinet 120, and to valve 122 for actuation of the cylinder 72 to open and close the lower gate 80 in the dump mechanism 18. Another orifice 150 supplies nitrogen to purge an enclosure 152 for the load cell 44.

Figure 15:
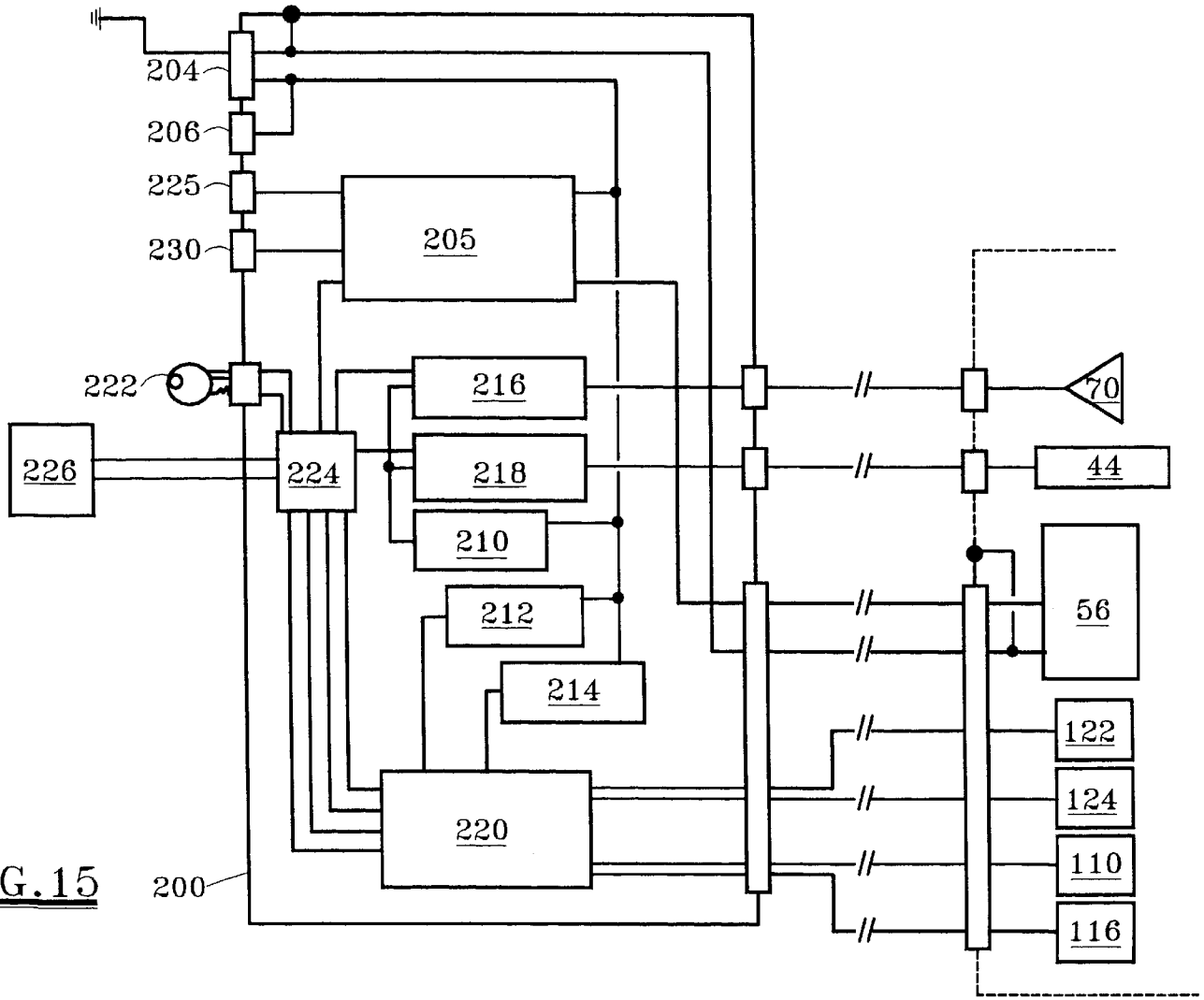
FIG. 15 is a schematic diagram of a control system for the propellant blending system of FIG. 1.

The propellant blending system of FIGS. 1–14 can be operated remotely by operator and/or computer control. An exemplary control system schematic illustrated in FIG. 15 includes a control system housing 200 which can be located a remote distance from the apparatus of FIGS. 1–14 to provide operator safety. Electrical connection between the control system housing 200 is provided via the umbilical 128. The housing 200 is electrically connected to a ground 202 and is supplied with power, for example, 115 volts alternating current at input 204. The input 204 supplies power to an auxiliary power receptacle 206, motor driver/controller assembly 208 and power supplies 210, 212 and 214. The auxiliary power receptacle 206 can be mounted in a plate in the front or back of the housing 200 to use as an outlet for associated equipment, such as, for example, computer 226 and/or video monitor. Power supply 210 provides 24 volt direct current power to signal conditioners 216 and 218 which receive inputs from thermocouple 70 and load cell 44, respectively. Power supplies 212 and 214 supply 5 volt and 24 volt direct current power, respectively, to valve driver assembly 220. The motor driver/controller assembly 208, valve driver assembly 220, signal conditioners 216 and 218 and a key switch 222 are connected to computer 226 via junction block 224. The motor driver/controller assembly 208 can be selected between local and remote operational modes by means of selection switch 228 mounted on a front panel of the housing 200. In local operating mode, the speed of the motor 56 is controlled by the motor driver/controller assembly 208 via local speed controller 230 which is similarly mounted in a panel of the housing 200 adjacent to the selection switch 228. The valve driver assembly 220 provides output for operating dump mechanism actuator valve 122, dump mechanism vent valve 124, solenoid valve 110 and decant valve 116. Signal conditioners 216 and 218 provide input to the computer for the thermocouple 70 and load cell 44. The key switch 222 provides input to the computer 226 to indicate safe or armed status.

In operation of the propellant blending system of FIGS. 1–15, a solution of the binder and the fuel particles are placed in the container assembly 12. A premeasured quantity of oxidant particles is deposited in the chute 70 of dump mechanism 18. The tank 96 is filled with countersolvent as necessary and padded with nitrogen via line 100. The pivoting arm 36 is moved outwardly and the container assembly 12 is positioned to align the lugs 30A,30B,30C in the respective enlarged ends 29A,29B,29C. The container assembly 12 is then moved upwardly with the lugs 30A, 30B,30C engaged in the slots 28A,28B,28C, the pivoting arm 36 moved in to place the support 40 below the container assembly 12, and the container 12 positioned thereon. The motor 56 is started to mix the contents of the container assembly 12. A countersolvent preload is added to the container assembly 12 by opening valve 110. Countersolvent passes through gravity leg 112, supply/decant line 114 and tube 22 into the container assembly 22, while maintaining agitation.

After the countersolvent preload is placed in the container assembly 12, the oxidant particles are dumped from the dump mechanism 18 into the container assembly 12, while maintaining agitation. Opening and closing the lower gate 80 several times helps to dislodge residual particles into the container assembly 12. The countersolvent is then metered into the container assembly 12 by opening or pulsing the metering valve 110 to supply countersolvent at a predetermined rate through the gravity leg 112, decant/supply line 114 and dip tube 22. When sufficient countersolvent has been metered into the container assembly 12, agitation can be continued for a period of time to allow the particle aggregates to increase in size. Then, while maintaining agitation, the valve 110 is opened to supply excess countersolvent. While maintaining agitation, the contents of the container assembly 12 are stirred for a sufficient period of time to allow the aggregated particles to harden. The agitation is then stopped, and the particles allowed to settle to the bottom of the container assembly 22 as seen in FIG. 8.

Then the decant valve 116 is opened and the supernatant siphons from the container assembly 12 through the dip tube 22 and decant/supply line 114, out through gravity leg 112 and valve 116. When the liquid level in the container assembly 12 falls below the lower end of the dip tube 22 the siphon is broken by vapor. The valve 116 is then closed, and an additional countersolvent wash introduced via valve 110, gravity leg 112, decant/supply line 114 and dip tube 22. After checking the weight of the container assembly 12 via the load cell 44 to ascertain countersolvent addition, the motor 56 can be turned back on to mix the contents of the container assembly 12. The container assembly 12 is then removed, the propellant composition is screened in the countersolvent, and the recovered propellant particles dried in a vacuum oven.

Figure 16:
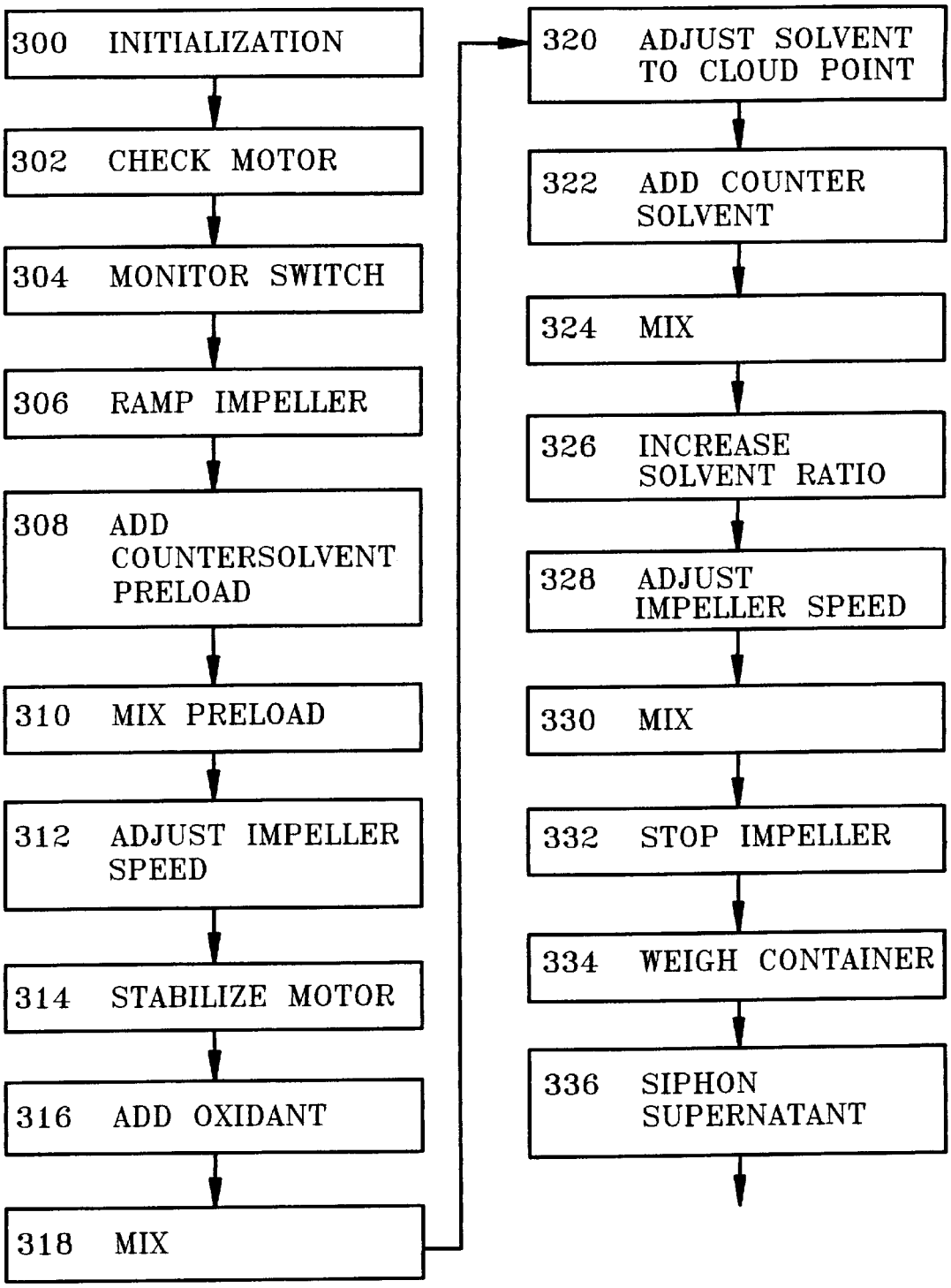
FIG. 16 is a typical propellant blending process software flowchart according to an embodiment of the invention.
Figure 16A:
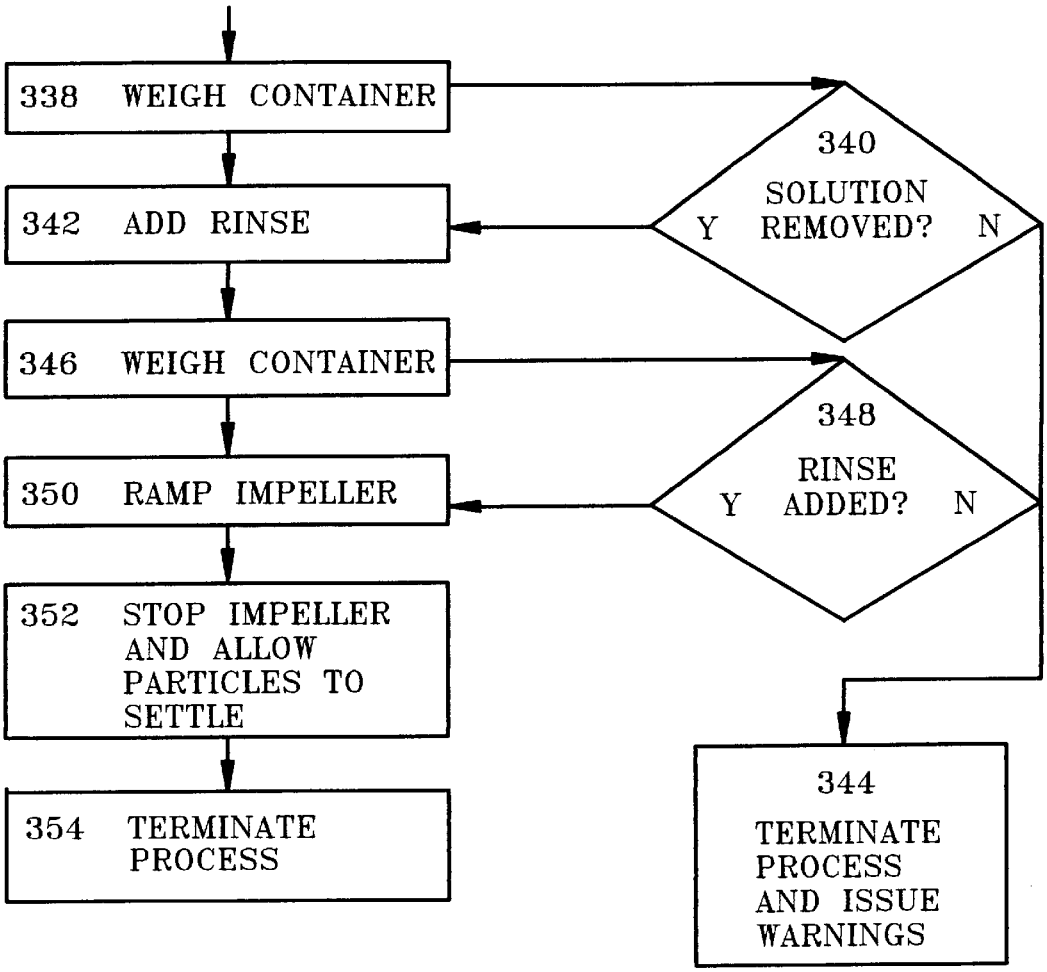

A typical process flowchart of software for blending propellant compositions using the apparatus of FIGS. 1–15 is illustrated in FIG. 16. The operator manually loads the binder solution and fuel components into the container assembly, and the oxidizer components into the powder dump mechanism. The operator sets the key switch in the armed position, and starts the software. In the initial logic block 300, the computer algorithm verifies that all valves are in the off position. In block 302, the algorithm checks to ascertain that the motor controller is in the remote operating mode. In block 304, the key switch is monitored for status in the safe or armed position. The status of the key switch can be checked, for example, every 55 milliseconds to make that it remains in the armed position throughout the propellant blending process. If the key switch is turned to the safe position, the process is automatically terminated and text and audible warnings can be issued.

In block 306 the impeller is ramped to mixing speed, for example 1000 rpm. In block 308, the countersolvent preload is added. This is a predetermined quantity, translated into a period of time that the valve 110 is maintained in the continuously open position. In block 310, the agitation is continued for a period of time after the countersolvent preload is added to insure proper mixing before coacervation is initiated. A time period of 20 seconds is typical. In block 312, the impeller speed is adjusted, for example, increased from a typical 1000 rpm preload mixing speed to 1200 rpm. The speed of the motor 56 is then allowed to stabilize for a period of time, for example, 5 seconds, in block 314. Then, in block 316, the oxidant particles are added by actuating the dump mechanism 18, preferably several times to shake loose any oxidant particles which may cling to the surfaces of the chute 74 and lower gate 80. The mixture is then agitated for a period of time, in block 318, for example, about 30 seconds, to insure thorough dispersion of the oxidant particles in the binder solution.

In block 320, the countersolvent-solvent ratio is brought up to initiate coacervation. Using the input from the thermocouple 70, the solution temperature is measured. Based on the temperature measurement, the computer algorithm calculates the cloud point based on data specific for the binder-solvent-countersolvent system. Based on the calculated cloud point, the countersolvent is added by continuously opening, or preferably pulsing, the valve 110. Once the countersolvent-solvent ratio of the cloud point is reached, the algorithm proceeds with block 344 to meter additional countersolvent into the container assembly 12 to a predetermined countersolvent-solvent ratio to precipitate a desired quantity of the binder from the solution. A countersolvent-solvent ratio of about 1.4 is typical in the heptane-acetone system with Viton B fluoropolymer in the preparation of ZPP propellant. Next, proceeding to block 324, the contents of the container assembly 12, are continuously mixed for a period of time to build aggregated particle size. A time period of 30 seconds is typical, although longer times can be used for obtaining larger particle aggregates. Then, in block 326, additional countersolvent is added, preferably by operating the valve 110 in a continuously open position, to achieve a predetermined countersolvent-solvent ratio, typically about 3.0 for the heptane-acetone system using Viton B fluoropolymer as the binder. The impeller speed can then be reduced in block 328 to minimize particle disaggregation which could result from excessive shear. In block 330, the mixing is continued for a period of time to allow the particles to finish hardening, typically on the order of 60 seconds. Proceeding next to block 332, the impeller is stopped and the particles are allowed to settle. The time required for settling depends on the specific components of the system, but a time period of about 10 seconds is typical. In block 334, the weight of the container measured by the load cell 44 is stored. The supernatant is siphoned next in block 336 by opening the decant valve 116. After allowing a sufficient period of time for the liquid to drain, in block 338, the load cell 44 reading of the weight of the container assembly 12 is taken and compared in block 340 with the weight stored in block 334. If the supernatant drained, additional countersolvent is added in block 342. If not, the software proceeds to block 344, terminating the process and issuing warnings.

After adding the countersolvent rinse in block 342, typically 1 liter, another load cell 44 reading is taken in block 346, and compared in block 348 with the reading stored in block 338. If the countersolvent added properly the software proceeds to block 350. If not, the software proceeds to termination/alarm block 344.

In block 350, the motor 56 is ramped to 1200 rpm, for example, for a relatively short time period, such as 10 seconds, to dislodge the settled particles, and then the speed is reduced to 1000 rpm, for example, for a longer period of time, e.g. 60 seconds, to thoroughly rinse the particles. Then in block 352, the motor 56 is stopped and the particles are again allowed to settle. Finally, the software terminates the process in block 354, turning all valves and outputs off, sounding an audible process end alarm, enforcing safe key operation and cycling the software for the next run. The operator can then remove the container assembly 12 for further processing of the propellant product as described above.

Figure 17:
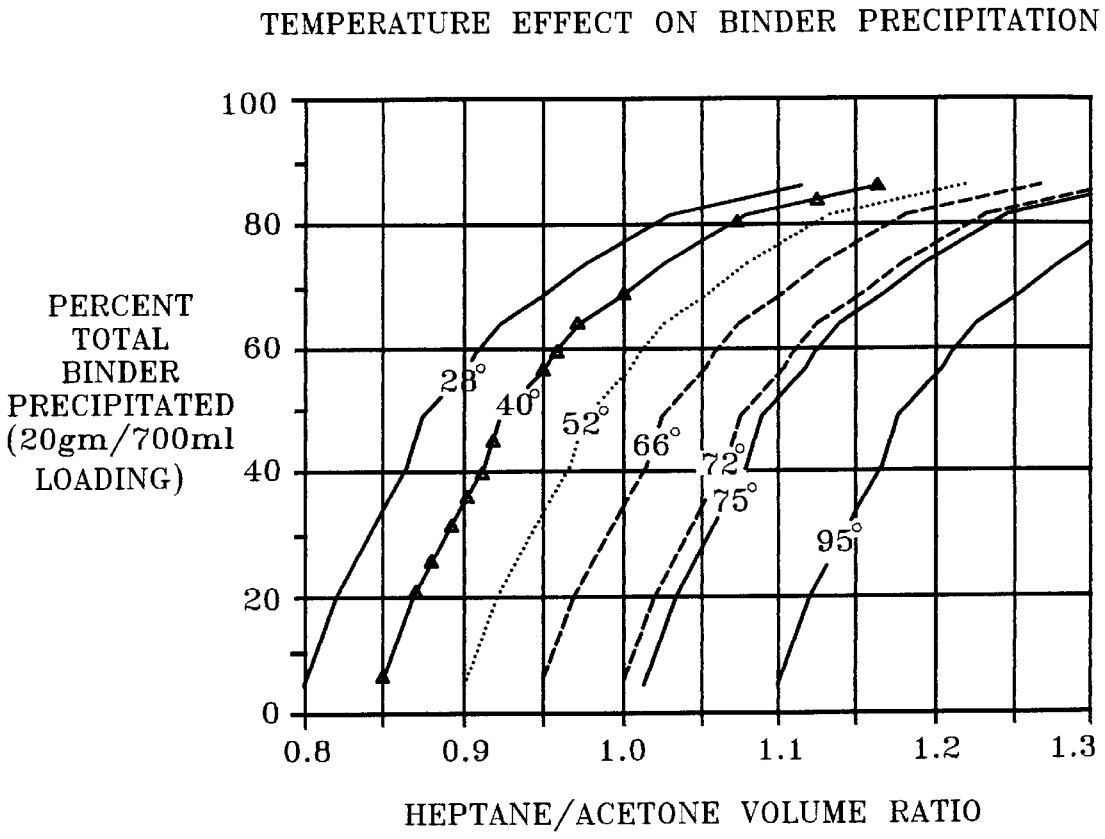
FIG. 17 is a graph of Viton B fluoropolymer precipitation from acetone using heptane versus countersolvent-solvent ratio at various temperatures at a loading of 20 g/700 ml.

The amount of countersolvent preload, countersolvent-solvent ratio at the coacervation point and the countersolvent-solvent ratio to achieve suitable binder viscosity in logic block 322 (FIG. 16), is based on data specific for the particular binder, solvent, binder loading and countersolvent. Thus, the data must be obtained for the binder, solvent and countersolvent which will be used in the propellant blending process, at the binder concentration that will be used. The data are developed as a set of curves which plot the percentage of binder precipitated as a function of the countersolvent-solvent volume ratio, over a range of temperatures likely to be observed during the blending process. A typical data matrix is illustrated graphically in FIG. 17 of the heptane-acetone system using Viton B fluoropolymer as the binder. The countersolvent preload is determined from this data to be about the most countersolvent which can be added without precipitating binder at the lowest temperature to be expected, taking into account ambient blending conditions as well as cooling resulting from any endothermic mixing of the solvent and countersolvent. For the heptane-acetone system of FIG. 17, the ratio is about 0.8.

From the data for the specific countersolvent-solvent-binder system, and empirical relationship between countersolvent-solvent ratio and coacervation temperature can be established as illustrated in FIG. 18. For use in the algorithm in logic block 320 of FIG. 16, it is useful to develop the relationship in the form an equation to calculate the countersolvent-solvent cloud point volume ratio as a function of the measured temperature.

For the countersolvent-solvent ratio used in logic block 322, it is desired to use the lowest ratio possible to precipitate about 50–90 percent of the binder, preferably 70–85 percent of the binder. If too much binder is precipitated too quickly, excessively large particles will form to an undesirable degree. If too little binder is precipitated, it is difficult to grow aggregated particle size properly.

EXAMPLE 1

The cloud point as a function of temperature and binder loading was determined empirically for Viton B fluoropolymer in acetone using heptane as the countersolvent. The data were obtained by adding heptane to a Viton B-acetone solution maintained in a temperature-controlled bath and recording the heptane-acetone volume ratio at the visually observed cloud point. The data are presented in Table 1.

TABLE 1

| Viton B Loading (wt % in acetone) | Temperature (° F.) | Cloud Point (heptane/acetone ratio) |
|---|---|---|
| 20 g/700 ml | 28 | 0.77 |
| | 52 | 0.88 |
| | 66 | 0.94 |
| | 72 | 0.98 |
| | 75 | 1.00 |
| | 95 | 1.08 |

From these data, the cloud point was curve fit to the following equation:

$$R_{CP}=0.637+0.0047T$$

wherein $R_{CP}$ is the heptane/acetone volume ratio at the cloud point, T is the temperature in ° F. Data for this Viton B-heptane-acetone system are presented graphically in FIGS. 17 and 18. It is noted that these data were developed for Viton B having Mw of 500,000 and polydispersity (Mw/Mn) of 2.3, and would be different for different grades of Viton B depending on Mw, Mw/Mn, monomer composition and other characteristics.

EXAMPLE 2

The apparatus of FIGS. 1–16 was used to prepare a simulated propellant. Tin powder (sp. gr.=7.31) was screened through a 325 mesh screen to simulate zirconium (sp. gr. 6.53). Sodium sulfate (sp. gr. 2.68) was screened through a 100 mesh screen to simulate potassium perchlorate (sp. gr. 2.52). The binder was Viton B fluoropolymer (Mw=500,000; Mw/Mn=2.30), the solvent was acetone and the countersolvent was heptane as in Example 1.

The mixing container was a 6-inch ID vessel equipped with a one-inch vertical baffle and a baffle gap of ¼ inch. The impeller was a 3-inch diameter axial flow impeller with rounded blades mounted on a vertical shaft positioned about one inch above the bottom of the mixing container and about ½-inch horizontally from the wall of the mixing container opposite the baffle, i.e. about 1 inch off center.

A solution of 20 g of Viton B fluoropolymer in 700 ml of acetone was charged to the mixing container with 208 g of the tin powder. The motor was ramped to 800 rpm and 595 ml of heptane was added. Agitation at 800 rpm was maintained for 20 seconds, and then increased to 1200 rpm. The sodium sulfate (168 g) was added while maintaining the impeller at 1200 rpm. After 30 seconds, the temperature was measured to be 65° F. and the cloud point determined from the equation of Example 1 to be a heptane/acetone ratio of 0.94. Additional heptane (63 ml) was added to reach the cloud point. While maintaining the impeller at 1200 rpm, 140 ml more of heptane was pulsed into the mixing container over a 15 second time period by rapidly opening and closing a ½-inch Marrotta solenoid-operated valve, and the mixture stirred for 30 seconds. Then, 1302 ml of heptane were immediately added (90 ml/second) while maintaining the impeller at 1200 rpm. Stirring at 1200 rpm was continued for an additional 60 seconds after the heptane/acetone ratio was brought to 3.0.

The impeller was then stopped and the particles allowed to settle to the bottom of the mixing container. The siphon valve was opened to drain liquid until a vapor break occurred, corresponding to a liquid level about ½-inch above the settled particles. Removal of the liquid was confirmed by load cell readings. Then 1000 ml of heptane were added, the heptane addition confirmed by load cell readings, the container stirred at 1200 rpm for 60 seconds. The impeller was then turned off and the container removed.

The particles from the container were wet screened on a 20 mesh screen to remove oversized particles (about 5 g). The product was spread thinly on a tray and dried overnight in an oven at 140° F. The recovered particles were screened and had the particle size distribution shown in Table 2. The repetition of the above procedure obtained reproducible results.

TABLE 2

| Screen Size (mesh) | Particle Size (microns) | Weight Percent Retained on Screen |
|---|---|---|
| 30 | 595 | 0.8 |
| 40 | 420 | 1.3 |
| 50 | 297 | 2.1 |
| 60 | 250 | 11.3 |
| 80 | 177 | 68.6 |
| 100 | 149 | 15.3 |
| 200 | 74 | 0.5 |

EXAMPLE 3

The procedure of Examples 1 and 2 is followed to prepare a ZPP propellant for use in a NASA standard initiator (NSI). The NSI propellant is prepared with 52 weight percent zirconium, 42 weight percent potassium perchlorate, 5 weight percent Viton B fluoropolymer and 1 weight percent graphite. The zirconium specification is Mil-Z-399D, Type II, Class II with a maximum hafnium content of 3 percent without ball milling to the final size. The potassium perchlorate is Mil-P-217, Grade A, Class 4 again with no ball milling to the final size. The Viton B fluoropolymer follows Dupont Sales Specification No. 14, 1985-02-06. The graphite is specified as Mil-G-155, Grade III, with a particle size less than 1 micron.

A solution of 20 g of Viton B fluoroelastomer in 700 ml of acetone is charged to the mixing container with 208 g of the zirconium powder and graphite. The impeller is brought to 1200 rpm and 595 ml of heptane preload are added. Agitation at 1200 rpm is maintained for 20 seconds and then the potassium perchlorate (168 g) is added while maintaining the impeller at 1200 rpm. After 30 seconds, the temperature is measured to be 65° and the cloud point is determined from the equation of Example 1 to be a heptane/acetone ratio of 0.94. Additional heptane (63 ml) is added to reach the cloud point. While maintaining the impeller at 1200 rpm, 322 ml more of heptane is pulsed into the mixing container over a 35 second time period by rapidly opening and closing a ½ inch Marrofta solenoid valve. The mixture is then stirred for 360 seconds. Then 1120 ml of heptane are immediately added (90 ml/second) while maintaining the impeller rate at 1200 rpm. Stirring at 1200 rpm is continued for an additional 60 seconds after the heptane/acetone ratio is brought to 3.0.

The impeller is then stopped and the particles allowed to settle to the bottom of the mix container. The siphon valve is opened to drain liquid until a vapor break occurs corresponding to a liquid level about ½ inch above the settled particles. Removal of the liquid is confirmed by load cell readings. Then 1000 ml of heptane are added, the heptane addition confirmed by load cell readings, the container stirred at 1200 rpm for 3 seconds, and then reduced to 1000 rpm for 60 seconds. The impeller is then turned off and the container removed.

The particles from the container are wet screened on 30 mesh screen to remove oversized particles (<1 gram). The product is spread thinly on a tray and dried overnight in an oven at 140° F. The ZPP product has a caloric content ranging from 1340 to 1450 calories per gram.

What is claimed is:

1. A method for preparing a solid propellant mixture of aggregated oxidant and fuel particles in a binder, comprising the steps of:

(a) admixing solid particles in a solution of the binder in a mixing container equipped with a variable-speed impeller and a countersolvent supply system, wherein the solid particles have a size smaller than a desired particle size of the aggregated particles;

(b) adding a first countersolvent portion to the admixture of step (a) while maintaining agitation; wherein the first countersolvent portion is less than or about equal to an amount needed for coacervation without effecting coacervation;

(c) while agitating with the impeller, metering a second countersolvent portion from the countersolvent supply system into the mixture of step (b) to exceed the countersolvent-solvent ratio required for coacervation to precipitate the binder and form aggregated particles, wherein a countersolvent metering rate and impeller speed are matched to obtain the desired particle size distribution of the aggregated particles;

(d) admixing excess countersolvent into the mixture from step (c) while maintaining agitation with the impeller;

(e) maintaining agitation of the mixture from step (d) for a period of time to allow the binder in the aggregated particles to harden;

(f) optionally rinsing the hardened aggregated particles from step (e) with additional countersolvent.

2. The method of claim 1 wherein the solid particles comprise an oxidant and a fuel.

3. The method of claim 2 wherein the particles comprise zirconium and potassium perchlorate.

4. The method of claim 1 wherein the binder comprises an elastomer.

5. The method of claim 4 wherein the elastomer is a terpolymer of hexafluoropropylene, vinylidene fluoride and tetrafluoroethylene.

6. The method of claim 1 wherein steps (a) and (b) include the sequential steps of charging the mixing container with the binder solution, fuel particles, optional processing aids, and a countersolvent preload comprising all or part of the first countersolvent portion, mixing the contents of the mixing container, and while maintaining mixing of the mixing container, adding a charge of oxidant particles to the mixing container.

7. The method of claim 6 wherein the oxidant particle charge addition, countersolvent metering step (b) and excess countersolvent admixing step (c) are remotely actuated.

8. The method of claim 1 including empirically determining the coacervation point for the countersolvent-solvent system as a function of temperature and estimating the countersolvent ratio of the coacervation point for step (b) based on the empirical determination.

9. The method of claim 8 wherein step (b) includes the sequential steps of adding a preload of countersolvent to within about 20 percent of the countersolvent-solvent ratio of the coacervation point to avoid coacervation, allowing the admixture to thermally equilibrate, measuring the temperature of the admixture, and calculating the countersolvent-solvent ratio needed for coacervation at the measured temperature, and then adding the second countersolvent portion to the admixture in step (c) to exceed the calculated ratio of countersolvent to solvent.

10. The method of claim 9 wherein the countersolvent metering rate in step (c) is relatively slower than a rate of countersolvent addition in step (b).

11. The method of claim 9 including terminating the countersolvent metering of step (c) and maintaining agitation of the mixture with the impeller for a period of time effective to aggregate the particles to the desired particle size distribution prior to step (d).

12. The method of claim 1 wherein the rinsing step (f) includes stopping agitation of the mixture and allowing the aggregated particles to settle, decanting supernatant and adding additional countersolvent.

13. The method of claim 1 wherein the countersolvent supply system includes first and second countersolvent supply modes, wherein the first mode has a high countersolvent flow rate for steps (b) or (d) relative to a low countersolvent flow rate of the second mode for step (c).

14. The method of claim 13 wherein the countersolvent supply system includes a first flow path for delivering countersolvent to the mixing container at the relatively high flow rate of the first countersolvent supply mode, and a second countersolvent flow path in parallel with the first flow path for delivering countersolvent to the mixing container at the relatively low flow rate of the second countersolvent supply mode.

15. The method of claim 14 wherein the countersolvent supply system includes a valve in a countersolvent flow path operable in a continuously open mode delivering countersolvent to the mixing container at the relatively high flow rate of the first countersolvent supply mode, and operable in a pulsed open and closed mode at a frequency selected to provide the relatively low flow rate of the second countersolvent supply mode.

16. The method of claim 12 wherein the rinsing step (f) further includes comparing the mixing container weight with a remote sensor before and after the decantation step to confirm removal of the supernatant liquid.

17. The method of claim 16 wherein the rinsing step (f) further includes comparing the mixing container weight before and after the additional countersolvent addition to confirm the countersolvent addition, and stirring the mixing container with the impeller.

18. The method of claim 9 wherein the temperature of the mixing container is measured with a remote sensor.

19. A method for preparing a solid propellant mixture of aggregated oxidant and fuel particles in a binder having a predetermined particle size distribution, comprising the steps of:

(a) charging a mixing container, equipped with a variable-speed impeller and a countersolvent supply system, with a solution of the binder, the fuel particles and optional processing aids;

(b) admixing a first countersolvent portion into the charge of step (a) while maintaining agitation, wherein the first countersolvent portion is less than or about equal to an amount needed for coacervation without causing coacervation;

(c) while maintaining mixing of the admixture from step (b), adding a charge of the oxidant particles thereto;

(d) allowing the admixture from step (c) to thermally equilibrate;

(e) measuring the temperature of the admixture from step (d);

(f) determining the countersolvent-solvent ratio required for coacervation at the measured temperature;

(g) while agitating the mixing container with the impeller, metering a second countersolvent portion from the countersolvent supply system into the admixture from step (d) in excess of the coacervation point to precipitate the binder and form aggregated particles, wherein a countersolvent metering rate and impeller speed are matched to obtain the predetermined particle size distribution of the aggregated particles;

(h) admixing excess countersolvent into the mixture from step (g) while maintaining agitation with the impeller;

(i) maintaining agitation of the mixture from step (h) for a period of time to allow the binder in the aggregated particles to harden;

(j) stopping agitation of the mixture from step (i) and allowing the aggregated particles to settle in the mixing container;

(k) decanting supernatant from the mixing container;

(l) adding additional countersolvent to the mixing container, agitating the mixing container and repeating steps (j) and (k).

20. The method of claim 19 wherein the amount of the first countersolvent portion comprises at least about 80 percent of the amount of countersolvent needed for coacervation.

* * * * *